US011634927B2

(12) United States Patent
Moore

(10) Patent No.: US 11,634,927 B2
(45) Date of Patent: Apr. 25, 2023

(54) NONCONDUCTIVE, MODULAR BARRIER ASSEMBLIES AND RELATED METHODS

(71) Applicant: CBM Non-Conductive Solutions LLC, Morrsiville, PA (US)

(72) Inventor: Donald E. Moore, Morrisville, PA (US)

(73) Assignee: Vanquish Fencing Incorporated, Morrisville, PA (US)

( * ) Notice: Subject to any disclaimer, the term of this patent is extended or adjusted under 35 U.S.C. 154(b) by 0 days.

(21) Appl. No.: 16/856,923

(22) Filed: Apr. 23, 2020

(65) Prior Publication Data

US 2021/0040768 A1 Feb. 11, 2021

Related U.S. Application Data

(60) Provisional application No. 62/879,038, filed on Jul. 26, 2019, provisional application No. 62/838,007, filed on Apr. 24, 2019.

(51) Int. Cl.
*E04H 17/16* (2006.01)
*E06B 11/02* (2006.01)

(52) U.S. Cl.
CPC ..... *E04H 17/16* (2013.01); *E06B 11/02* (2013.01)

(58) Field of Classification Search
CPC ..... E04H 17/003; E04H 17/009; E04H 17/13; E04H 17/16; E04H 17/1602; E04H 17/165; E04H 17/166; E04H 17/18; E04H 17/185; E06B 11/00; E06B 2009/002; E01F 13/02; E01F 13/022
See application file for complete search history.

(56) References Cited

U.S. PATENT DOCUMENTS 65,372 A * 6/1867 Gibbs ..... E04H 17/16 256/31
255,673 A * 3/1882 Robinson et al. ..... E04H 17/16 256/31
321,978 A * 7/1885 Kemery ..... E04H 17/16 256/31
391,132 A * 10/1888 Fellows ..... E04H 17/16 256/31
404,856 A * 6/1889 Ogilvie ..... E04H 17/18 256/26
1,545,909 A * 7/1925 McKinnon ..... E01F 7/02 256/12.5
1,956,767 A * 5/1934 Kibler ..... E04H 17/143 256/21

(Continued)

*Primary Examiner* — Jonathan P Masinick
(74) *Attorney, Agent, or Firm* — Calderone Bullock LLC

(57) ABSTRACT

The present invention provides a modular, nonconductive barrier assembly for enclosing or partitioning an area. The modular, nonconductive barrier assembly includes a number of wall panels each having multiple nonconductive posts arranged in a common plane and separated by a gap. The nonconductive posts are connected by a number of connecting rods. Each wall panel is arranged in an upright orientation on a support surface. A number of support assemblies each having a base and at least one support arm support the wall panels in an upright orientation. The base of each support assembly is positioned on a support surface, a proximal end of the support arm is releasably connected to the base and a distal end of the support arm is releasably connected to a wall panel to support the same.

8 Claims, 27 Drawing Sheets

(56) References Cited

U.S. PATENT DOCUMENTS

| | | | | | |
|---|---|---|---|---|---|
| 2,821,365 | A * | 1/1958 | Lach | H01B 17/145 | 256/19 |
| 2,976,346 | A * | 3/1961 | Bellamy | H01B 17/145 | 174/158 F |
| 3,378,694 | A * | 4/1968 | Griffeth | H05C 1/04 | 307/132 R |
| 3,551,920 | A * | 1/1971 | Greene | E04H 4/0062 | 52/149 |
| 4,339,114 | A * | 7/1982 | Deike | E01F 7/02 | 256/12.5 |
| 4,412,396 | A * | 11/1983 | Silbernagel | G09F 7/18 | 40/607.11 |
| 4,909,483 | A * | 3/1990 | van Herpen | E04G 21/3228 | 256/59 |
| 5,647,451 | A * | 7/1997 | Reichel | E04G 21/3214 | 182/113 |
| 5,779,227 | A * | 7/1998 | Elkins | E04H 17/18 | 256/24 |
| 7,234,275 | B1 * | 6/2007 | Haggy | E01F 13/022 | 160/135 |
| 8,070,136 | B2 * | 12/2011 | Alberts | E04H 17/18 | 256/24 |
| 2008/0149786 | A1 * | 6/2008 | Bradley | F16B 9/054 | 248/121 |
| 2012/0261632 | A1 * | 10/2012 | Bertucat | E01F 13/022 | 256/26 |
| 2017/0356203 | A1 * | 12/2017 | Nagel | E04G 21/32 | |
| 2018/0371790 | A1 * | 12/2018 | Westfahl | E04H 17/20 | |

* cited by examiner

NONCONDUCTIVE, MODULAR BARRIER ASSEMBLIES AND RELATED METHODS

CROSS REFERENCE TO RELATED APPLICATIONS

This application claims the benefit under 35 U.S.C. § 119(e) of each of U.S. Provisional Patent Application Ser. No. 62/838,007, filed Apr. 24, 2019 and entitled "Nonconductive, Modular Barrier Assemblies" and U.S. Provisional Patent Application Ser. No. 62/879,038, filed Jul. 26, 2019 and entitled "Nonconductive, Modular Barrier Assemblies", the entire disclosures of each of which are incorporated herein by reference.

BACKGROUND OF THE INVENTION

The present invention relates to fences and/or barriers. Specifically, the present invention relates to nonconductive, modular barrier assemblies composed of nonconductive materials and which are particularly useful for enclosing an area in which a mobile substation or other energized electrical equipment is positioned.

Mobile substations are often deployed by electrical utilities to temporarily replace a substation during planned outages or emergency events. Substations may need to be closed for routine maintenance or repairs, and the equipment in the substation must be de-energized prior to performing any repair work on the substation. Storms and other extreme weather events may also cause substations to fail, requiring the utility to take measures to provide a temporary source of power until the substation can be brought back online.

In the event of the closure of a substation for any of these reasons, a mobile substation may be transported to the desired location to temporarily replace the closed substation. To facilitate transportation, the mobile substation and related equipment may be positioned on a trailer or semi-trailer. Mobile substations include various types of energized equipment, such as transformers, switchgears, protection and control equipment, and generators, among other types of equipment.

Once the mobile substation is deployed, it is often necessary to install a temporary barrier in order to promote safety and to prevent unauthorized access of the mobile substation or other energized equipment by persons or animals. The energized electrical equipment can be highly dangerous and may pose a risk of electrical shock to those in the nearby area. Further, the barrier also limits access to the mobile substation so that unauthorized users are not able to tamper with or damage the equipment.

Temporary barriers are commonly installed to enclose the area containing the mobile substation in order to limit access to the mobile substation. However, conventional temporary barriers have numerous drawbacks. Specifically, conventional temporary barriers may be difficult and time-consuming to assemble and disassemble. Such temporary barriers generally lack a foundation or other stable connection to a support surface and are therefore prone to being displaced or knocked over, particularly during a storm, hurricane, or other extreme weather event having high winds.

Additionally, many conventional temporary barriers are composed of metal or include metal components, such as metal posts or fencing material. As a result, such metal temporary barriers are generally electrically conductive. These electrically conductive barriers must be grounded to prevent the metal barrier from becoming energized, which may pose a risk of electrical shock to those who come into contact with the energized metal barrier. However, grounding a metal temporary barrier can be problematic. The utility deploying the mobile substation and temporary barrier generally does not own the land on which the temporary barrier is installed. If the metal temporary barrier is installed on a paved surface, such as a road or parking lot, grounding cannot readily be accomplished without damaging the paved surface. Further, grounding the metal temporary barrier may be time consuming and may take several hours or days to complete, which can be undesirable or impractical in emergency situations.

Accordingly, there is a need in the art for a nonconductive, modular barrier system that can be readily assembled and disassembled and which can be customized as necessary to enclose or partition a desired area, such as an area containing a mobile substation. Further, there is a need for a nonconductive, modular barrier system that does not readily conduct electricity and which does not require grounding while also providing sufficient strength and stability for prolonged outdoor use and exposure to environmental elements.

BRIEF SUMMARY OF THE INVENTION

The present invention relates to a nonconductive, modular barrier assembly, comprising one or more wall panels each comprising a plurality of nonconductive posts that are arranged in a common plane and are separated by a gap, i.e., spaced apart, wherein the plurality of nonconductive posts are connected by one or more connecting rods, and each of the one or more wall panels is arranged on a support surface; and one or more support assemblies each comprising a base and at least one support arm, wherein the base is positioned on a support surface, a proximal end of the at least one support arm is releasably connected to the base and the distal end of the at least one support arm is releasably connected to a wall panel of the one or more wall panels.

The one or more wall panels may be arranged at an angle relative to the support surface of about 50 to about 85 degrees. Further, the one or more wall panels may comprise two or more wall panels arranged in a side-by-side manner.

The nonconductive, modular barrier assembly may optionally further comprise a corner assembly comprising a first panel with a first lateral edge and a second lateral edge, and a second panel with a first lateral edge and a second lateral edge, wherein the second lateral edge of the first panel is releasably connected to the second lateral edge of the second panel such that the first panel is arranged nonlinearly with respect to the second panel, wherein the corner assembly is positioned such that the first panel and the second panel are substantially perpendicular to the support surface, and a wall panel of the one or more wall panels is connected to the first lateral edge of the first panel or the first lateral edge of the second panel.

The first panel and the second panel of the corner assembly may each comprise a plurality of nonconductive posts arranged in a common plane and separated by a gap, i.e., spaced apart, wherein the plurality of nonconductive posts are connected by one or more connecting rods.

Further, the first lateral edge of the first panel of the corner assembly may be angled relative to the second lateral edge such that a wall panel of the one or more wall panels connected to the first lateral edge of the first panel of the corner assembly is disposed at an angle relative to the support surface.

The nonconductive, modular barrier assembly may optionally further comprise a gate assembly comprising a first panel having a first lateral edge and a second lateral edge, a second panel having a first lateral edge and a second lateral edge, and a gate having a first lateral edge and a second lateral edge, wherein the first panel and the second panel are positioned substantially parallel to one another and substantially perpendicularly with respect to the support surface, a first lateral edge of the gate is releasably connected to a second lateral edge of the first panel, and the second lateral edge of the gate is releasably connected to a second lateral edge of the second panel, wherein the gate is positioned substantially perpendicularly with respect to the support surface, and wherein a wall panel of the one or more wall panels is connected to one of the first lateral edge of the first panel and the first lateral edge of the second panel.

Each of the first panel and the second panel of the gate assembly may comprise a plurality of nonconductive posts arranged in a common plane and separated by a gap, i.e., spaced apart, wherein the plurality of nonconductive posts are connected by one or more connecting rods.

The present invention further relates to a nonconductive, modular barrier system for partitioning or enclosing an area, comprising one or more wall panels each comprising a plurality of nonconductive posts that are arranged in a common plane, wherein each post of the plurality of nonconductive posts is separated by a gap, i.e., spaced apart, and wherein the plurality of nonconductive posts are connected by one or more connecting rods; and one or more support assemblies for supporting the one or more wall panels on a support surface, wherein the one or more support assemblies each comprises a base and at least one support arm having a proximal end configured for releasable connection to the base and a distal end configured for releasable connection to a wall panel of the one or more wall panels.

The plurality of nonconductive posts of the one or more wall panels may be substantially parallel to one another. Further, each of the plurality of nonconductive posts may comprise a first plate and a second plate arranged substantially perpendicularly to the first plate, wherein the first plates of the plurality of nonconductive posts are arranged in the common plane, and the one or more connecting rods connect the second plates of the plurality of nonconductive posts. In a preferred embodiment, each of the plurality of nonconductive posts has a T-shaped transverse cross sectional area.

The one or more connecting rods may be arranged transversely to the plurality of nonconductive posts. The nonconductive, modular barrier assembly may comprise two or more connecting rods that are spaced along a longitudinal axis of each of the plurality of nonconductive posts.

The plurality of nonconductive posts may comprise a reinforced plastic. Each of the plurality of nonconductive posts may be substantially the same length. The gap between each of the plurality of nonconductive posts is preferably about 0.375 inches to about 2.0 inches.

The at least one support arm of the one or more support assemblies may have a bracket on the distal end of the at least one support arm that is releasably connectable to a wall panel of the one or more wall panels. Similarly, the proximal end of the at least one support arm of the one or more support assemblies may have a bracket that is releasably connectable to the base of the one or more support assemblies. One or more releasable fasteners may also be provided that are configured to secure the base of the one or more support assemblies to a wall panel of the one or more wall panels.

The system may further comprise a corner assembly as described herein. The first panel and the second panel of the corner assembly may each have a generally trapezoidal shape. The length of the plurality of nonconductive posts of each of the first and second panels of the corner assembly may increase from a first lateral edge of each panel toward the second lateral edge of each panel.

The system may further comprise a gate assembly as described herein. The first panel and the second panel of the gate assembly may each have a generally trapezoidal shape. Each of the first and second panels of the gate assembly may comprise a plurality of nonconductive posts that are arranged in a substantially common plane with leeway for topography of the site and the plurality of nonconductive posts are separated by a gap, i.e., spaced apart and are connected by one or more connecting rods.

The present invention further relates to a method for installing a nonconductive, modular barrier assembly, comprising providing a modular barrier system comprising one or more wall panels each comprising a plurality of nonconductive posts that are arranged in a common plane and which are separated by a gap, i.e., spaced apart, and wherein the plurality of nonconductive posts are connected by one or more connecting rods; and one or more support assemblies, wherein the one or more support assemblies each comprises a base and at least one support arm releasably connected to the base; arranging the one or more wall panels in an upright orientation on a support surface; and arranging the base of the one or more support assemblies on the support surface and releasably connecting the at least one support arm of a support assembly of the one or more support assemblies to a wall panel of the one or more wall panels.

The method may further comprise arranging the wall panels at an angle relative to a support surface. Further, the method may comprise providing a corner assembly and/or a gate assembly as described herein and releasably connecting the wall panels to the corner assembly and/or gate assembly.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
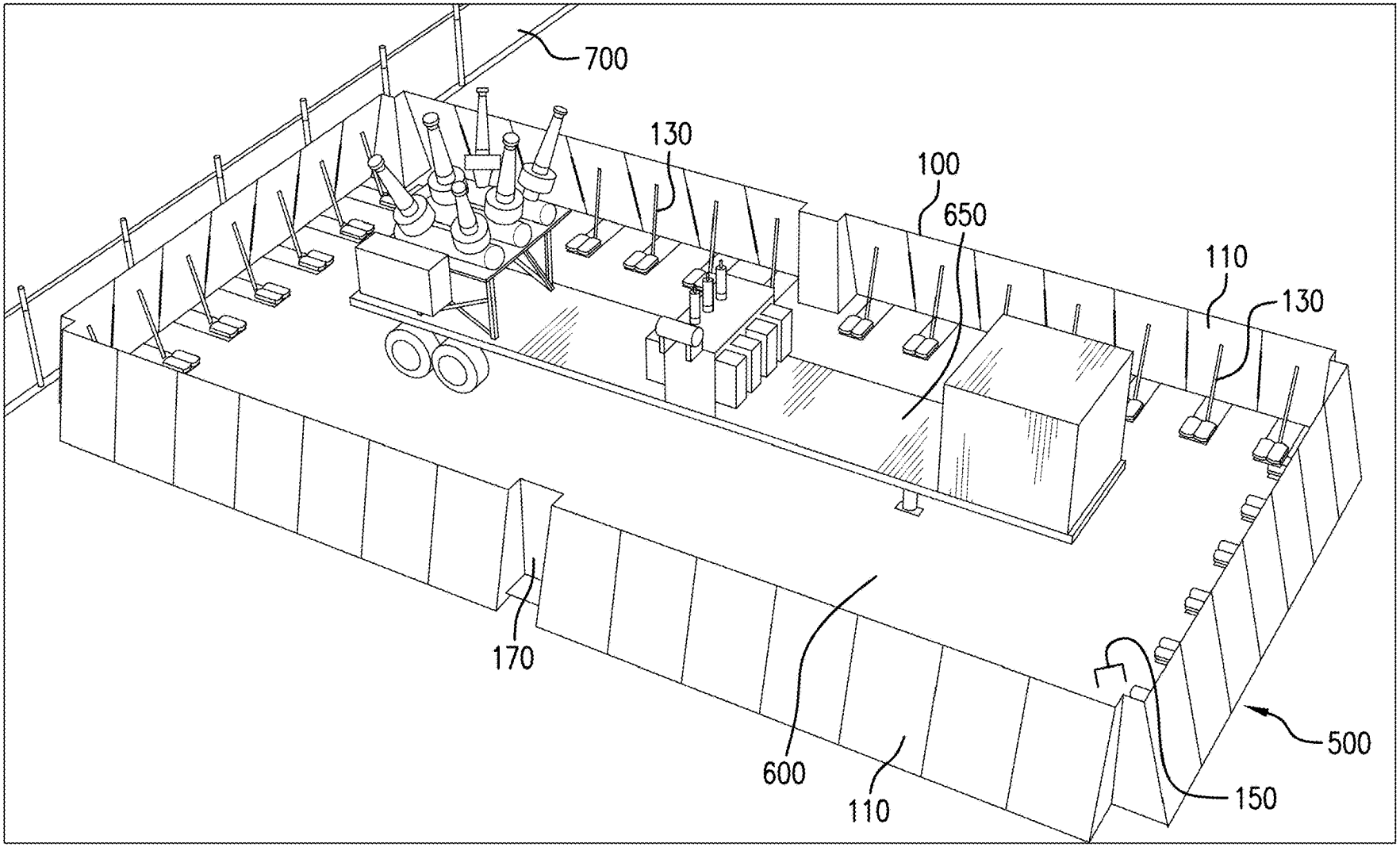
FIG. 1 is a perspective view of a nonconductive, modular barrier assembly constructed in accordance with the present invention.

The present invention relates to nonconductive, modular barrier assemblies. The nonconductive, modular barrier assemblies of the present invention can be easily and rapidly assembled and disassembled in a desired location to provide a temporary barrier. Advantageously, the configuration of the nonconductive, modular barrier assembly can be customized to enclose or partition areas of various sizes and formats. The nonconductive, modular barrier assembly can be used to partition or partially or fully enclose an area of land either alone or in combination with existing barriers, walls, fences, and the like.

While the nonconductive, modular barrier assemblies and systems of the present invention are described as being particularly useful for enclosing an area containing a mobile substation or other energized equipment, it is understood that this environment is not intended to be limiting and the nonconductive, modular barrier assemblies and systems of the present invention can be used to enclose or partition any parcel of land, and can be used independently of mobile substations and electrical equipment. For example, in a disaster scenario, they mat be used to enclose a neighborhood area containing downed, "live" electrical wires, to prevent inadvertent electrical injury of passersby.

As used herein, the term "nonconductive" indicates that a material or component has little to no electrical conductivity. Electrical conductivity is the measure of a material's ability to conduct an electric current (Helmenstine, 2018). Substations typically use more conductive metals such as Copper (electrical conductivity of $5.96\times10^7$ S/m) and Aluminum (electrical conductivity of $3.5\times10^7$ S/m) in their substation designs to aid in the flow and distribution of electrical current (Helmenstine, 2018). In comparison, 316 Stainless Steel (that has an electrical conductivity of $1.45\times10^7$ S/m), is approximately 24.5 times less conductive than aluminum and 41.1 times less conductive than copper. With a much lower electrical conductivity, stainless steel makes a suitable metal to use for small hardware applications in the nonconductive barrier modular assembly. The assembly may use, for example, fiberglass panels, rods, and hardware which has negligible electrical conductivity, usually less than $1\times10^{-14}$ S/m. In return, fiberglass makes an excellent insulator that doesn't allow electrical current to flow freely through the material, thus giving it the ability of having nonconductive properties.

Any reference herein to a "support surface" refers to a surface on which the modular barrier assembly is installed. Support surfaces may include any indoor or outdoor surfaces, such as the ground, whether dirt, rock, grass, sand, concrete, macadam, or stone, among others.

The present application in some embodiments will be described using words such as "upper" and "lower," "inner" and "outer," "right" and "left," "interior" and "exterior," and the like. These words and words of similar directional import are used for assisting in the understanding of the invention when referring to the drawings or another component of the invention and, absent a specific definition or meaning otherwise given by the specification, such terms should not be considered limiting to the scope of the invention.

Figure 1A:
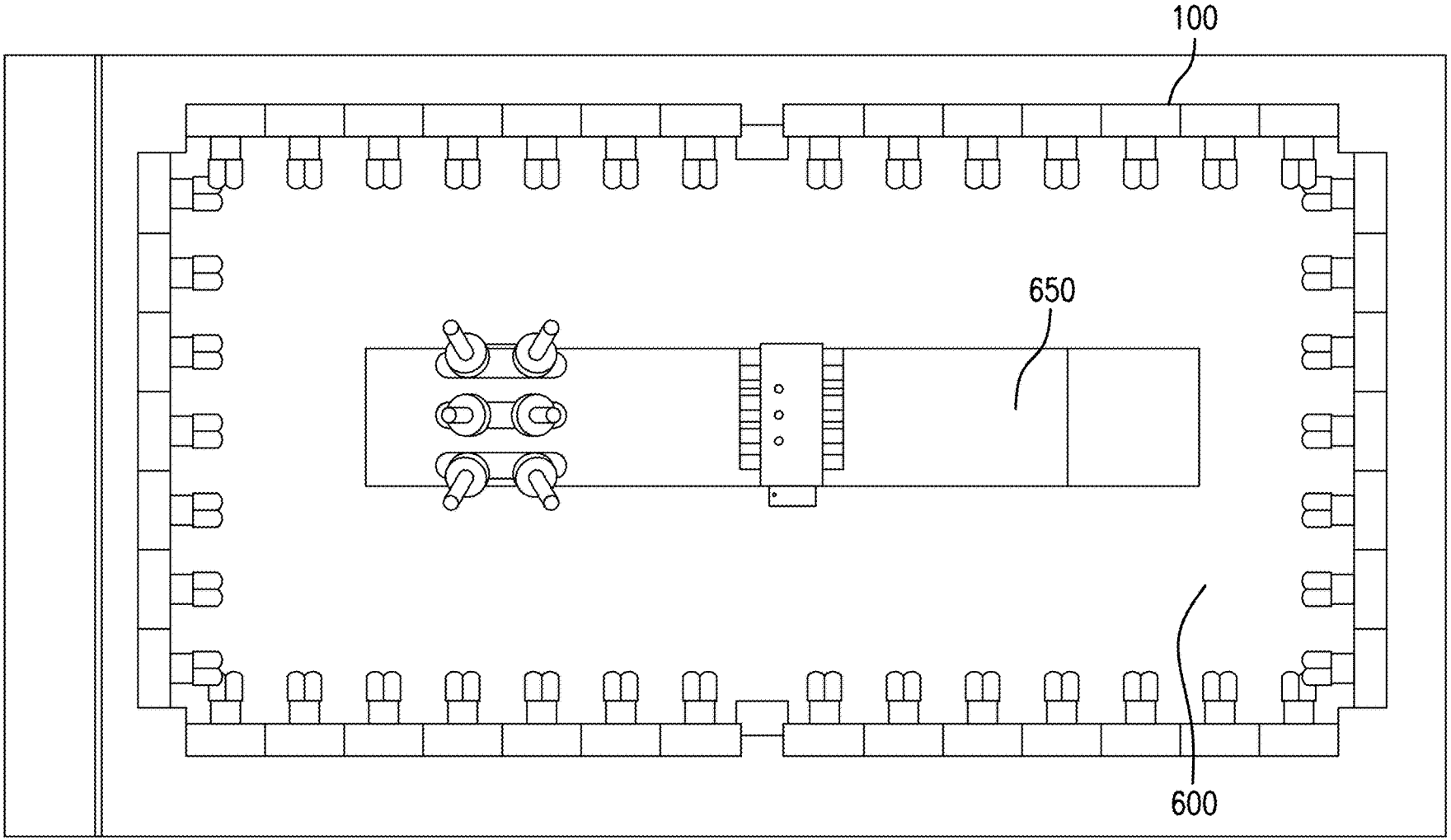
FIG. 1A shows a top plan view of the assembly of FIG. 1.

Referring now to, inter alia, FIGS. 1 and 1A, there is shown a perspective view of a nonconductive, modular barrier assembly constructed in accordance with an embodiment of the present invention. In the illustrated embodiment, several nonconductive, modular barrier assembly subunits 100 is installed serially so as to enclose an area of land 600 containing energized equipment, e.g., a mobile substation 650, in front of an existing fence 700.

The modular barrier assembly subunit 100 includes one or more wall panels 110 connected to one another in a side-by-side manner to form a barrier and one or more support assemblies 130 which support the wall panels 110 in a desired position. In this embodiment, the wall panels 110 are positioned in a substantially upright orientation on a support surface 500. The support surface may be for example, the existing native surface, e.g., of earth, clay, tarmac, cement, concrete, or other natural or man made material. Alternatively, the surface may include or be a ridged construct, such as a platform, decking, plate, plank, and the like made of any material or a flexible overlay, such as a tarp, mat, or carpet made of, for example, rubber, textile, plastic, elastomer, polymers, asphaltic materials, foamed polymers, and the like.

The nonconductive, modular barrier assembly subunit 100 optionally may be attached to one or more corner assemblies 150 as shown for providing a continuous barrier about the perimeter of the enclosed area 600. In this embodiment, each corner assembly 150 is positioned substantially perpendicularly with respect to the support surface 500, and each corner assembly 150 can be releasably connected to the wall panels 110. Further, the nonconductive, modular barrier assembly subunit 100 and/or a corner assembly optionally may be attached to at least one gate assembly 170 as shown that provides access to the area enclosed. The gate assembly 170 is also positioned substantially perpendicularly with respect to the support surface 500, and the gate assembly 170 can be releasably connected to the wall panels 110.

Figure 2:
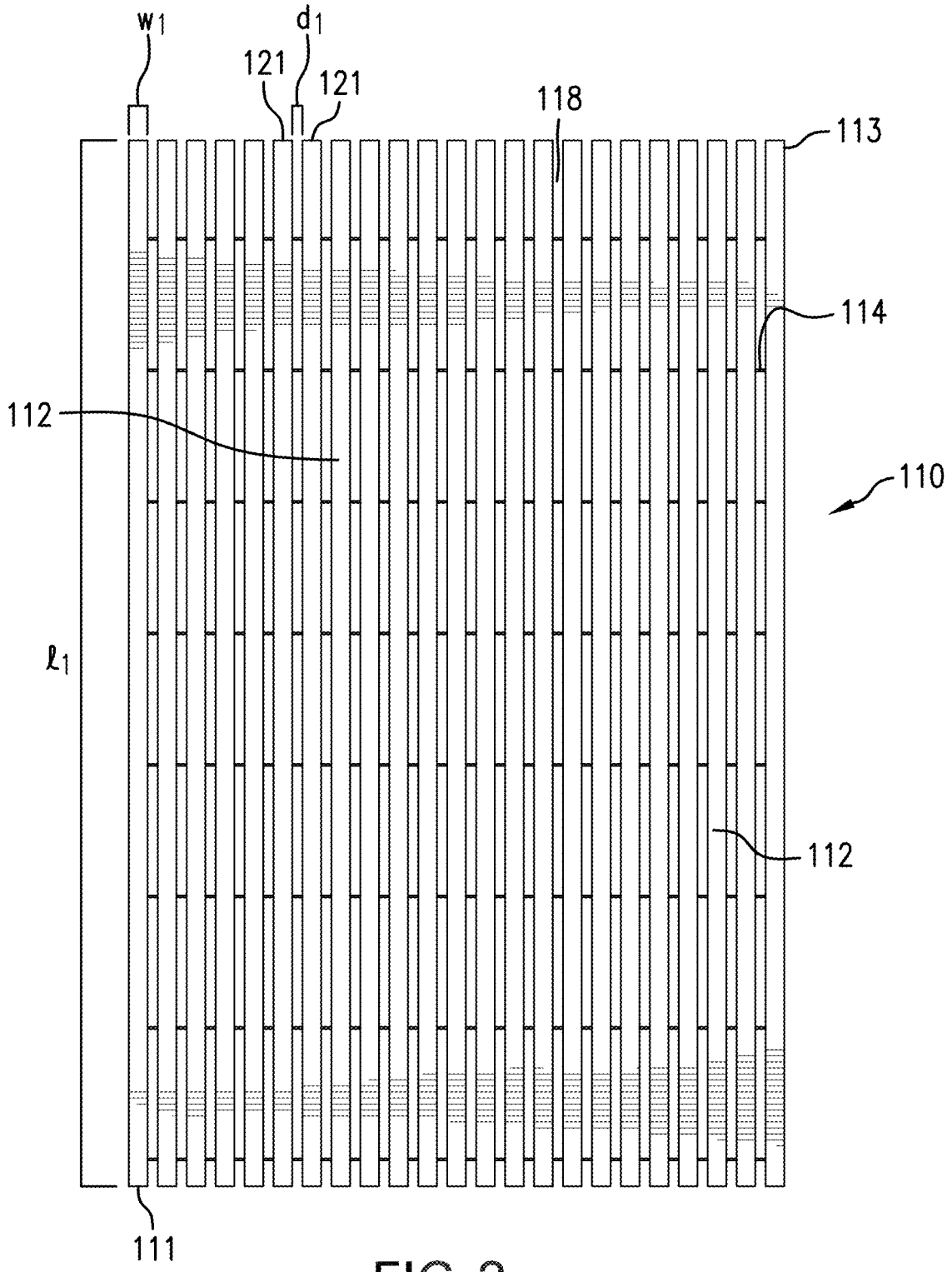
FIG. 2 is a front elevational view of a wall panel of the nonconductive, modular barrier assembly of FIG. 1.

Referring now to FIG. 2, there is shown an exemplary front view of a wall panel 110 of the modular barrier assembly. Each wall panel 110 includes a plurality of nonconductive posts or plates 112 each having a lower end 111 and an upper end 113. Each post 112 has a length, $l_1$, measured from the lower end 111 to the upper end 113 along a longitudinal axis Z of the post 112, and the length $l_1$ is preferably greater than the width, $w_1$, of the post or plate 112, the width being measured in a direction transverse to the longitudinal axis Z of the post 112. The posts may be any configuration, for example, dowel-like structures, i.e., having a circular cross-section. Preferably, however, at least an exterior surface 602 of the post (of the wall panel and/or the panels of the gate assembly or the corner assembly) may be substantially planar to present a flat, plate-like surface to an observer.

Further, it may be preferred that each post 112 of the plurality of posts is preferably substantially the same length. The length of the post may vary; generally, it is preferred that it is long enough to create a barrier that is high enough to discourage or prevent animals or people from climbing or jumping over it.

Figure 3:
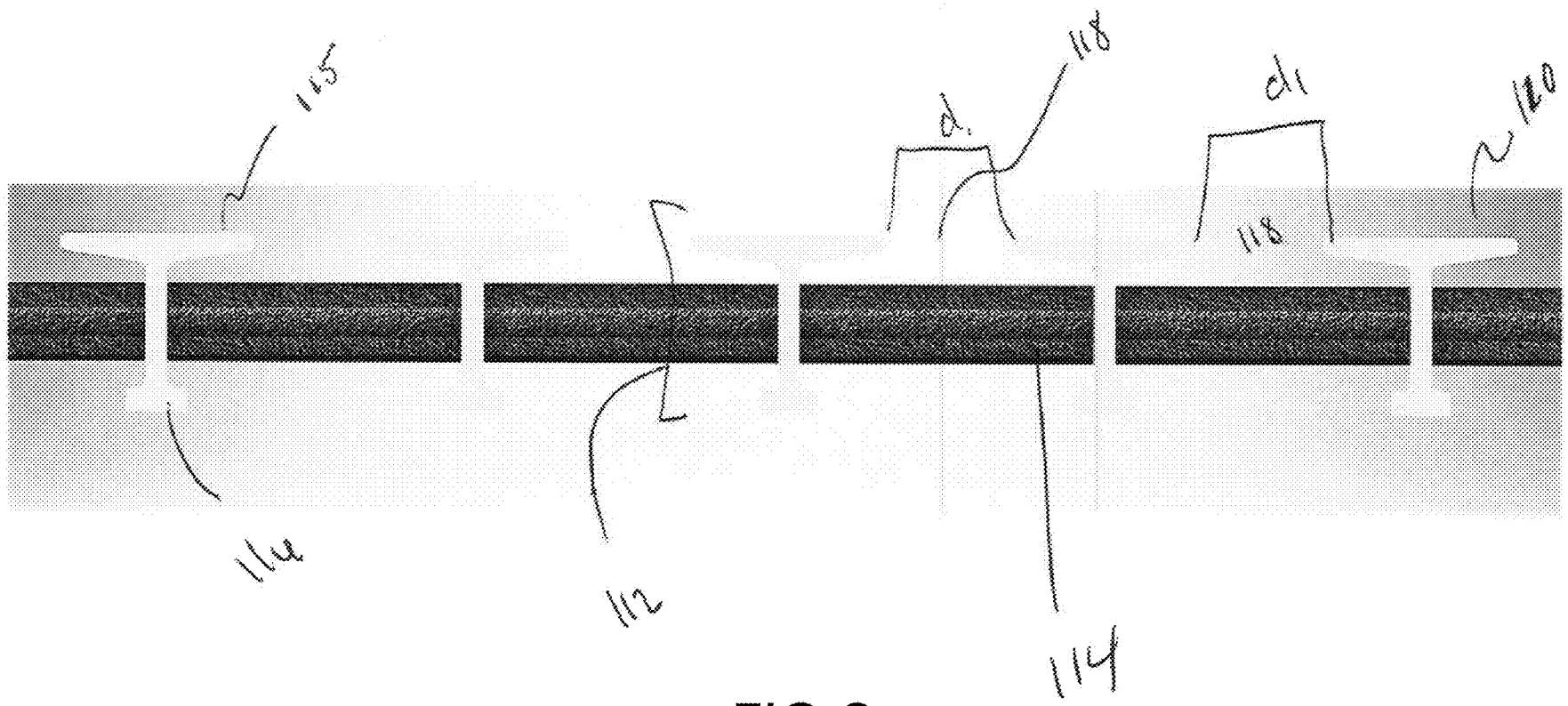
FIG. 3 is a top elevational view of the wall panel of FIG. 2.

The posts or plates 112 in each wall panel 110 may be arranged in a substantially common plane with leeway for topography of the site. Preferably, the posts or plates 112 in each wall panel 110 are arranged so that they are substantially parallel to one another. Each post 112 is separated from an adjacent post by a gap 118. The gap 118 is measured as the shortest distance between the edges of adjacent posts 112, as shown in FIG. 3. The distance, $d_1$, (which provides the gap 118) between adjacent edges 121 of the posts or plates 112 is preferably about 0.3 inches to about 2 inches. The gap 118 should be sufficient to allow weather to pass through the wall panel 110 so that the full force of the wind, rain or other weather is not exerted against the wall panel 110 which could cause a displacement of or even damage to the wall panel 110 and/or the assembly. Further, the gap 118 is sufficiently small so as to prevent humans and/or animals from passing through the gap 118 between the posts 112.

The posts or plates 112 in a wall panel 110 are connected to one another. Any connection may be used; it may be preferred that they are connected by one or more connecting rods 114 as is shown in the illustrated embodiment.

The connecting rods 114 are positioned generally transversely with respect to the posts or plates 112 and connect two or more posts 112. Preferably, each connecting rod 114 extends through all of the posts or plates 112 in the wall panel 110 of a given subunit. Each wall panel 110 may include multiple connecting rods 114 that are spaced from one another along the longitudinal axis of the posts 112. For example, a first connecting rod 114 extending transversely to the posts or plates 112 in a wall panel 110 may be positioned towards the lower end 111 of the posts or plates 112 and a second connecting rod 114 extending transversely to the posts or plates 112 in the wall panel 110 may be positioned towards an upper end 113 of the posts 112. In alternate embodiments, other means of connection can be used in place of or in combination with the connecting rods.

In may be preferred that the posts or plates 112 and connecting rods 114 (or equivalent) are each composed of a nonconductive material. Preferably, the nonconductive material is a plastic or a composite material. More preferably, the nonconductive material is a reinforced plastic, such as a fiber reinforced plastic. Various types of reinforcing materials may be used, such as glass or carbon fibers, among other nonconductive fibers and filling materials. The nonconductive material may alternatively be a stainless steel, such as 316 stainless steel. Further, the posts or plates 112 and connecting rods 114 may be made of the same or different nonconductive materials. As the modular barrier assembly subunit 100 is composed of nonconductive materials, the modular barrier assembly subunit 100 does not conduct electricity and does not need to be grounded.

In a preferred embodiment, each post 112 includes a first plate 115 and a second plate 116. The second plate 116 is disposed in space substantially parallel to the second plate 116 and connected to one another by a transverse member 123. Preferably, each post 112 has a T-shaped transverse cross sectional area as shown in FIG. 3. However, in alternate embodiments, each post 112 may have a transverse cross sectional area that is an I-shape, an L-shape or a C-shape, among others. The first plate 115 serves as the exterior of the wall panel 110, and the first plates 115 of the posts 112 are preferably arranged in a common plane. In some embodiments, the second plate 116 may be omitted.

The second plate 116 of each post 112 faces the area to be enclosed by the modular barrier assembly subunit 100. The transverse member 123 is substantially continuous from the upper end 113 of the post 112 to the lower end 111 of the post. The connecting rod 114 extends through the transverse members 123 to connect the individual posts 112. The connecting rods and the posts may be formed in the configuration (e.g., molded), assembled in this configuration with adhesives or fasteners or the transverse members may defined holes or apertures through which the connecting rods are threaded. See, e.g, FIGS. 3 and 4.

Figure 4:
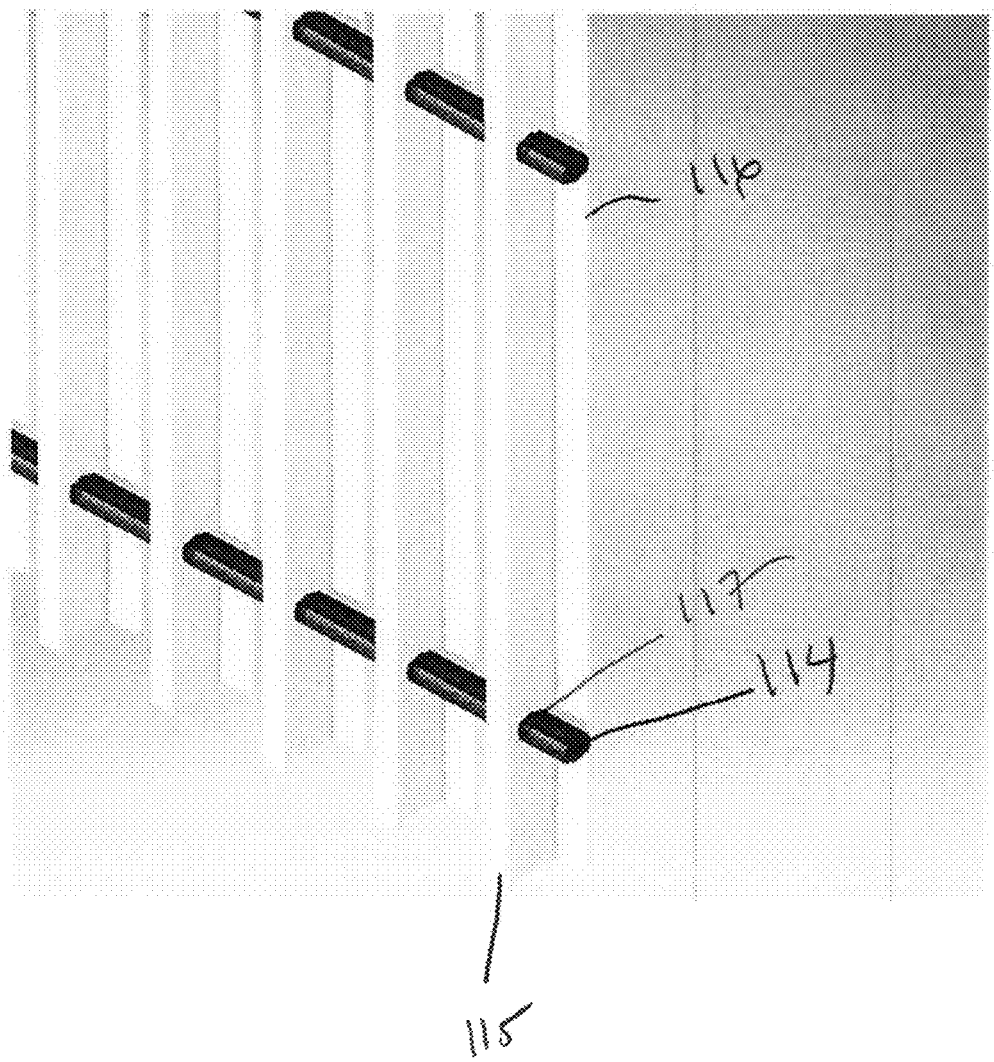
FIG. 4 is a rear perspective view of a post of the wall panel of FIG. 2.

As shown in FIG. 4, the posts or plates 112 may be formed so as to define one or more apertures 117 for receiving the connecting rods 114 in the transverse members 23. Preferably, the aperture 117 is formed so that when a connecting rod 114 is inserted therethrough, the connecting rod 114 is arranged transversely to the posts 112, as best shown in FIG. 3. By positioning the connecting rod 114 through the apertures 117 on the second plate 116 of each post 112, the connecting rod 114 is not accessible from the exterior of the wall panel 110 so that persons or animals outside of the area cannot access or damage the connecting rod 114.

Figure 5:
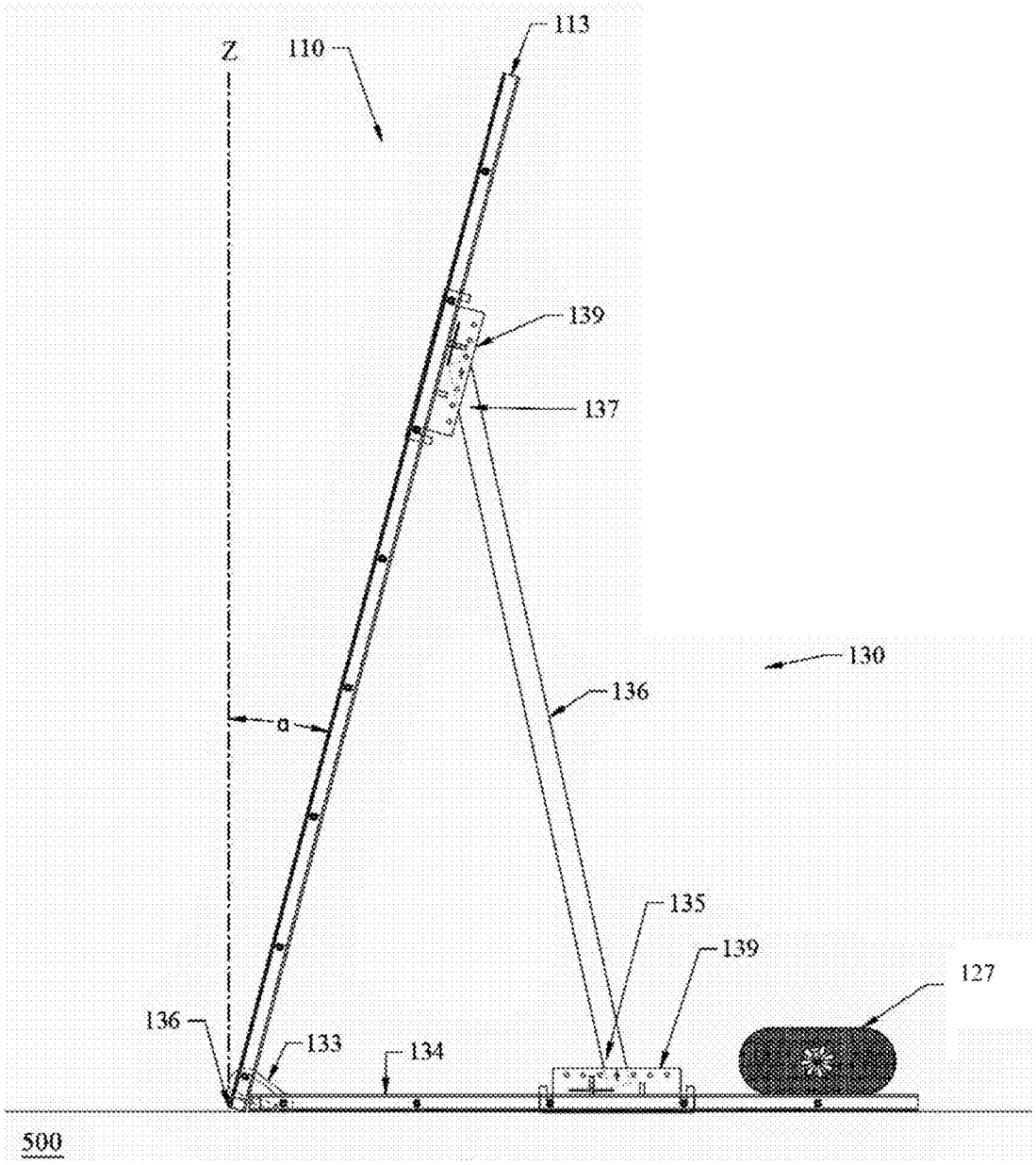
FIG. 5 is a side elevational view of a support assembly of the nonconductive, modular barrier assembly of the present invention as used to support a wall panel.
Figure 5A:
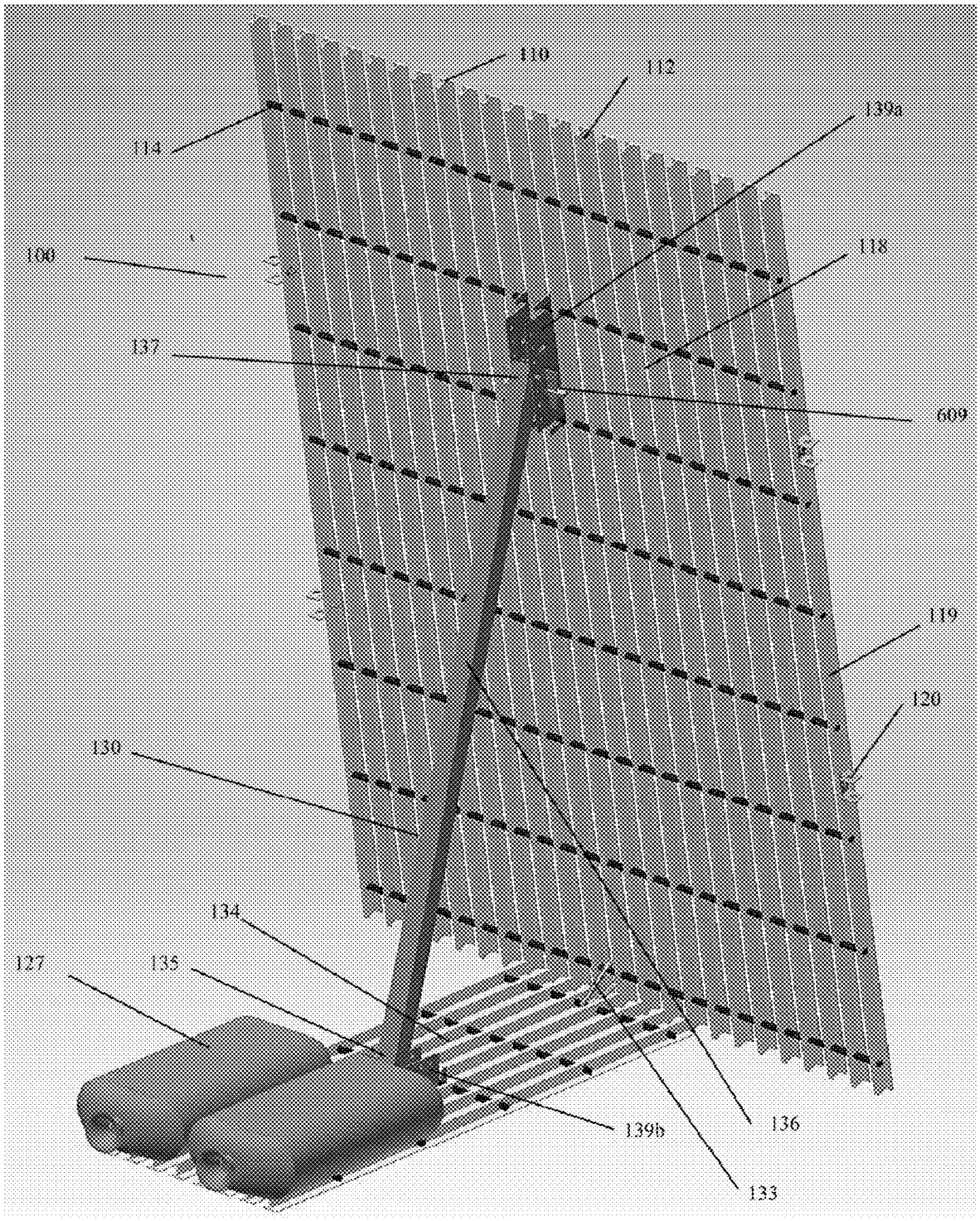
FIG. 5A is a rear perspective view of the barrier assembly of FIG. 5 showing each of the brackets of the support assembly of FIG. 5.

Referring now to FIGS. 5 and 5*a*, there is shown a side elevational view of a support assembly of the nonconductive, modular barrier subunit according to the present invention. One or more support assemblies 130 are used to support the wall panels 110 in a generally upright orientation on the support surface 500. When installing the modular barrier assembly subunit(s) 100, each wall panel 110 is preferably disposed at an angle, $\alpha_1$, relative to the support surface 500 on which the modular barrier assembly subunit 100 is positioned or the base 134, so that the wall panel 110 is tilted towards the enclosed area A as shown. Angle, $\alpha_1$, is preferably about 50 to about 85 degrees, and more preferably about 70 to about 80 degrees. The wall panels 110 are not secured directly to or within the support surface 500 and have no foundation. By tilting the wall panels 110 towards the enclosed area A, the support assemblies 130 are able to provide increased stability and support to the wall panels 110 relative to positioning the wall panels 110 in a vertical orientation on the support surface 500. Further, tilting the wall panels 110 may help to reduce the force exerted on the wall panels 110 by wind.

Each support assembly 130 includes a base 134 that can be placed directly on the support surface 500 and at least one support arm 136 for supporting the wall panel 110 in an upright orientation relative to the support surface 500. The base 134 may be substantially planar or may have a box-like configuration. One or more anchors, such as sand bags, metal plates, or other weighted objects can be positioned on the base 134 to further prevent the support assembly 130 from being displaced by wind or by manual interference, such as by a person or animal pushing or pulling the wall panel 110.

The support arm 136 of the support assembly 130 has a proximal end 135 and a distal end 137. The proximal end 135 is releasably connectable to the base 134 and the distal end 137 is releasably connectable to a wall panel 110. Preferably, the distal end 137 is releasably connected to a portion of the wall panel 110 towards the upper end 113 of the posts of the wall panel 110. The proximal end 135 and distal end 137 of the support arm 136 may each have a bracket 139 thereon that provides the releasable connection, as shown in FIG. 5A.

Preferably, the bracket 139 is a quick-release bracket so that the bracket 139 can be quickly connected and disconnected to assemble or disassemble the nonconductive, modular barrier assembly subunit 100. The support arm 136 can be arranged so as to support the wall panel 110 at the desired angle relative to the support surface 500.

Figure 5B:
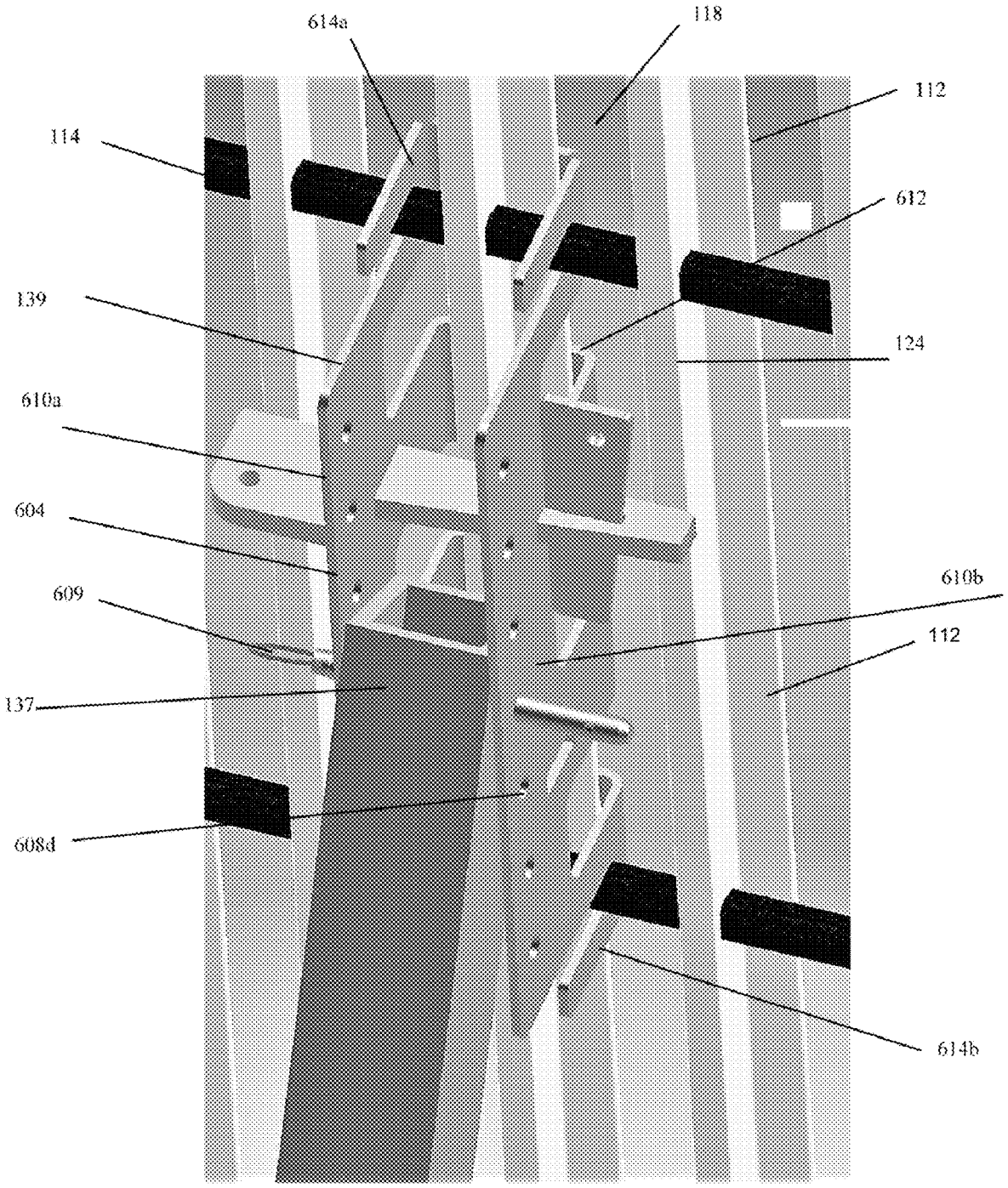
FIG. 5B is a detail rear view showing the bracket of the support assembly that connects to the wall panel.
Figure 5C:
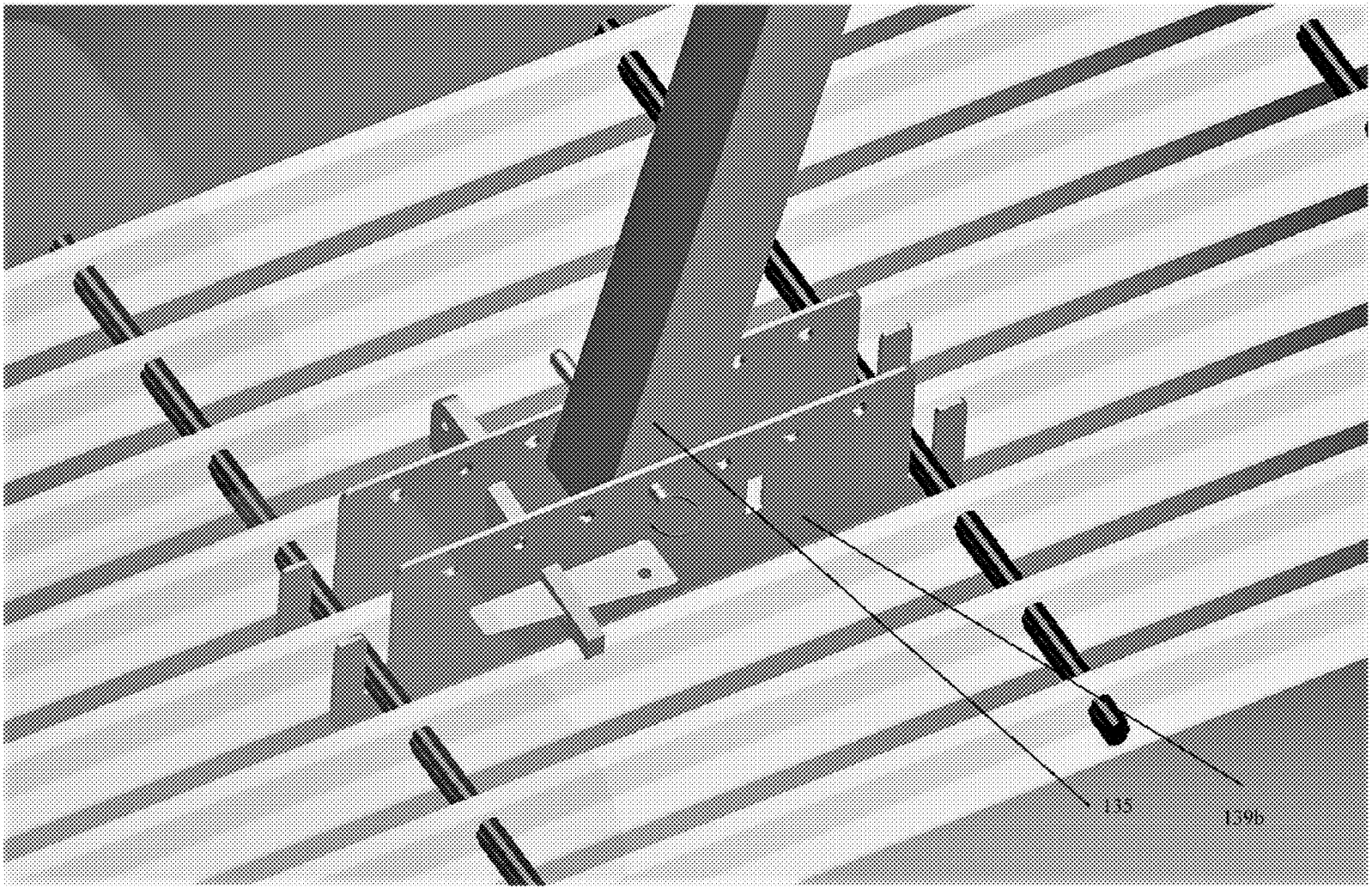
FIG. 5C is a detail view of the bracket of the support assembly that connects to the base of the support assembly.

FIGS. 5B and 5C show exemplary connection brackets. FIG. 5B is a detail rear view showing the bracket 139*a* of the support assembly that may be used to connect to the wall panel. The bracket 139*a* includes a bracket body 604 that is U-shape in cross section and the space defined by the arms (610*a*, 610*b*) and base (612) of the "U" is adapted to accept a portion of the support arm 136 (preferably portion at the distalmost end of the support arm). Each of the "U" arms defines a series of several holes (608 *a, a', b, b', c, c'* etc.) at different positions along the body 604; each hole defined in the first U arm 610*a* has a corresponding hole in the second U arm 610*b*. The support arm 136 bears a hole (not visible) and a reversible connection is made between the support arm 136 and the wall panel 110 by threading a pin 609 through a hole 608*a* in the first arm 610*a*, the hole in the support arm 136, and the hole 608*b* in the second arm 610*b*. Because the body 604 includes a series of corresponding holes, the position of the support arm 130 relative to the wall panel 110 can be varied, allowing for tilting of the wall panel 110 as the environment dictates.

Further, the bracket body 604 of bracket 139*a* includes an open loop (614*a*, 614*b*) at each end of the body 604. The open loops 614*a* and 614*b* are each configured to hook onto a connecting rod 157, 157' that is used in this illustrative embodiment to attach and secure the posts 112 to one another to form the wall panel 110. In this embodiment, the post 112 of the wall panel 110 is nested in the U's base 612 of bracket 139*a* to provide further stability of connection.

FIG. 5C is a detail view of the bracket 139*b* of the support assembly that connects to the base 134 of the subunit. In the embodiment of FIG. 5C the base in constructed of posts and connecting rods, like the wall panel of the subunit in FIG. 5B. The bracket 139*b* is identical to the bracket of 139*a* and is secured to the base and the proximal end of the support arm in the same way that the bracket 193*a* is to the wall panel in FIG. 5B.

Figure 11:
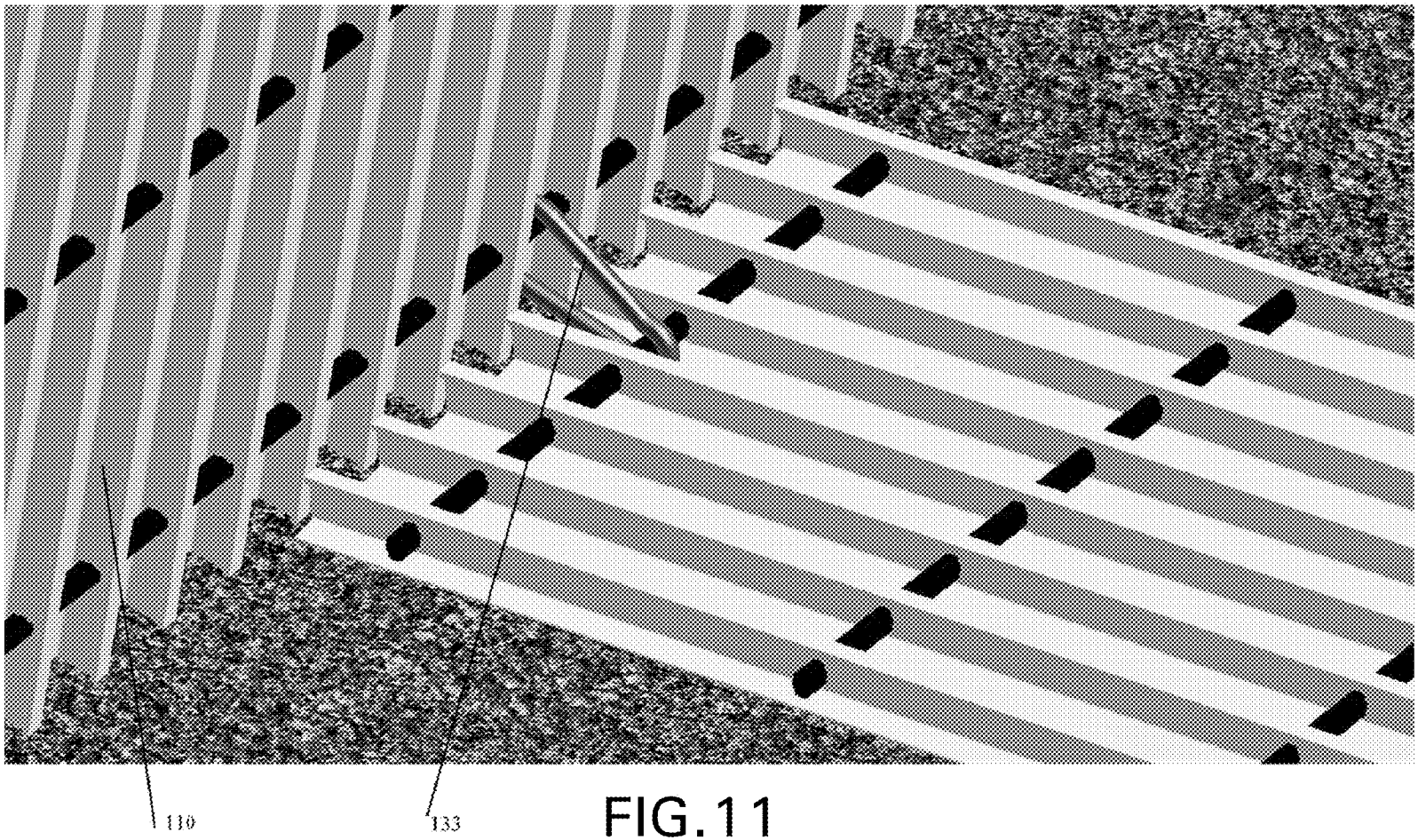
FIG. 11 shows an embodiment of the invention where a base is attached to a wall panel using a simple carbiner.

In order to further secure and support the wall panel 110, the base 134 of the subunit may be releasably connected to the wall panel 110 by one or more releasable fasteners 133. Preferably, the base 134 is connected to a portion of the wall panel 110 towards the lower end 111 of the posts of the wall panel 110. The releasable connection may be provided by any type of releasable fastener 133, such as a clip or carabiner 133. See FIG. 11.

The support assembly 130 is positioned in the area A (e.g., 600) to be enclosed by the modular barrier assembly subunit 100. As a result, the support assembly 130 cannot be accessed from the exterior side of the modular barrier assembly subunit 100 by unauthorized persons who may damage or tamper with the support assembly 130.

Depending upon the number of wall panels 110 used to construct the modular barrier assembly subunit 100, multiple support assemblies 130 may be required to support the wall panels, as shown for example in FIG. 1. Where multiple support assemblies 130 are required, the support assemblies 130 are spaced at an interval of about 3 feet to about 20 feet, and more preferably about 5 feet to about 8 feet.

To provide a barrier of the desired length, multiple wall panels 110 can be connected in a side-by-side manner so that a lateral edge of a first wall panel is connected to a lateral edge of a second wall panel. When the multiple wall panels 110 are connected, the first plate 115 of each post in each wall panel is arranged in a common plane. The wall panels 110 can be disposed at different elevations in order to install the modular barrier assembly subunit 100 on an uneven support surface, such as on a hill or incline. The multiple wall panels 110 may be connected in a side-by-side manner using a fastener, such as a clamp. The clamp is configured to secure a post of a first wall panel and a post of a second wall panel so as to hold the two panels together.

Figure 6:
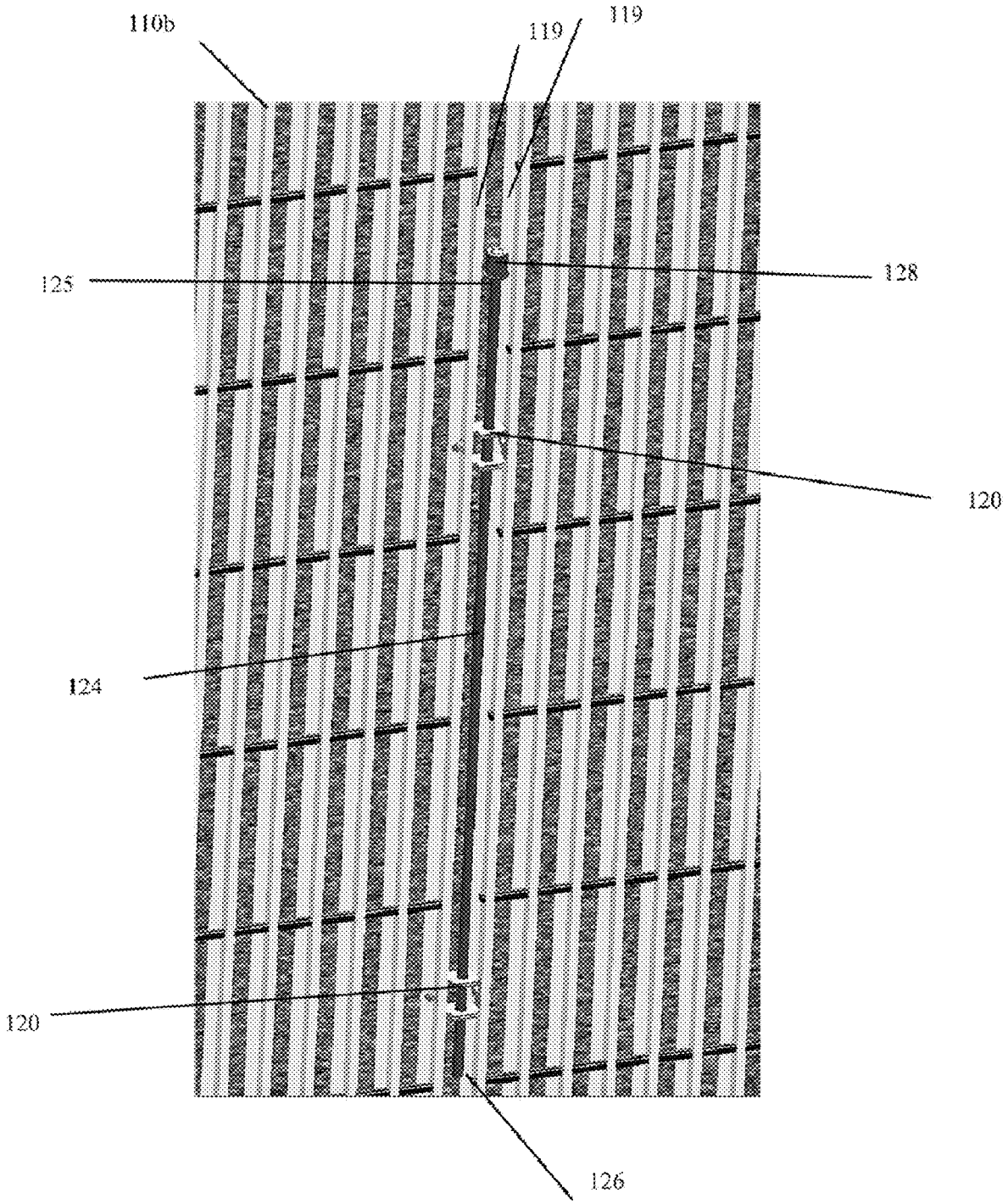
FIG. 6 is a perspective view of an embodiment of a wall panel of the nonconductive, modular barrier assembly, the wall panel in this embodiment having flanges each with an eyelet for receiving a rod, on the lateral edge of the wall panel.
Figure 6A:
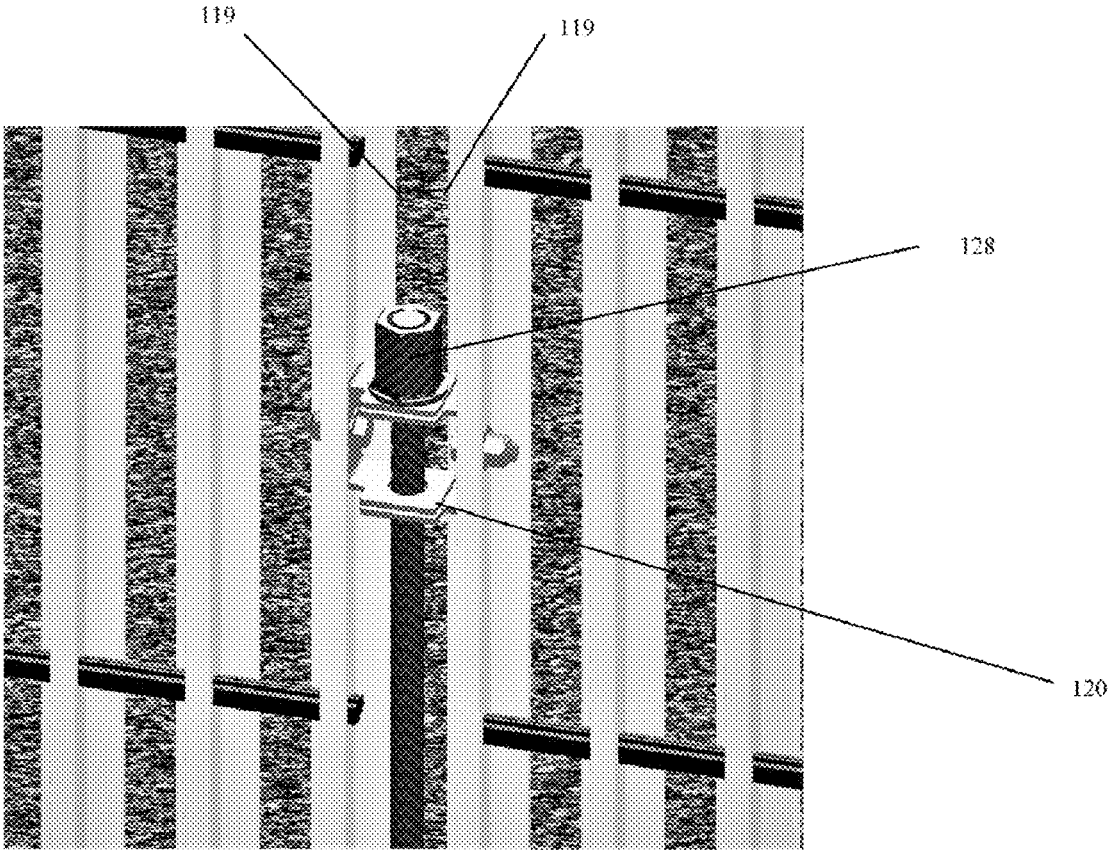
FIG. 6A shows a detail view of the eyelet-bearing flanges that receive the rod of FIG. 6.
Figure 6B:
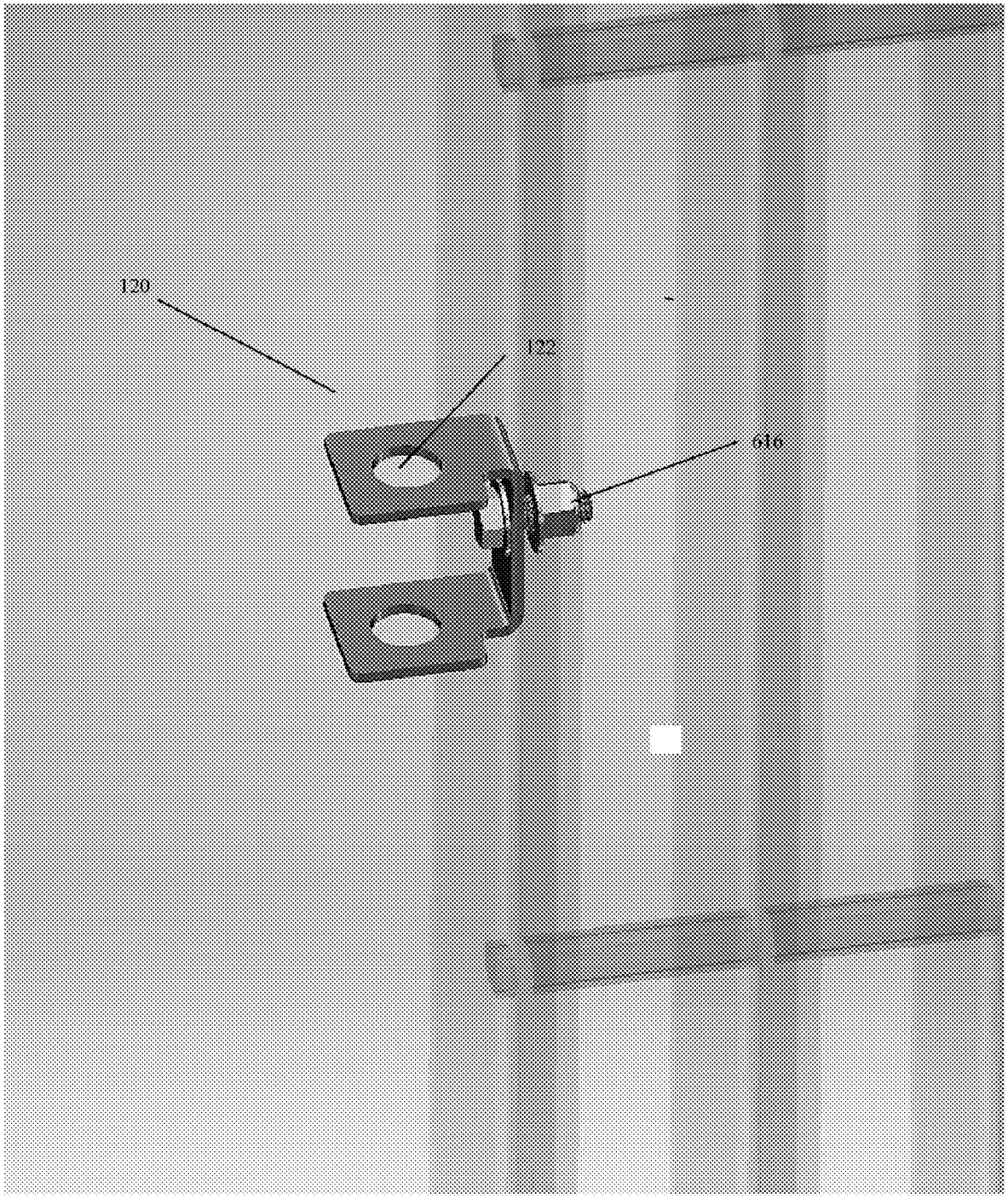
FIG. 6B shows an up-close view of a bolt-on flange with eyelets are used in the embodiment shown in FIG. 6.

In FIGS. 6, 6A, and 6B an exemplary way of connecting the subunits 100 to one another is shown. As shown in FIG. 6, each wall panel 110 may be formed so that its lateral edges 119 include one or more flanges 120 each defining an eyelet 122 for receiving a baton 124. The eyelets 122 of the flanges 120 of a first wall panel 110*a* can be aligned with the corresponding eyelets 122 of the flanges 120 of a second wall panel 110*b*, and a baton 124 or similar connector is be inserted through the aligned eyelets 122. The baton 124 includes a first end 125 and a second end 126. The flanges 120 can be formed integrally with the wall panels or posts or can be attached to the lateral edges, for example, by a mechanical fastener or an epoxy or glue. In this embodiment, a flange bolt 616 is shown.

Once the baton 124 is inserted through the aligned eyelets 122, a securement 128, such as a nut can be positioned on the top end 125 of the baton 124 in order to secure the baton 124 in position. The baton 124 may be made of a flexible or ridged material that is preferably substantially nonconductive.

In an embodiment, the support assembly 130 may be additionally secured in place by placing a weight or counterbalance on or attached to the base 134. See, e.g., FIGS. 5 and 5A ("counter ballast weight"), showing a counterbalance 127 on the base 134.

Figure 14:
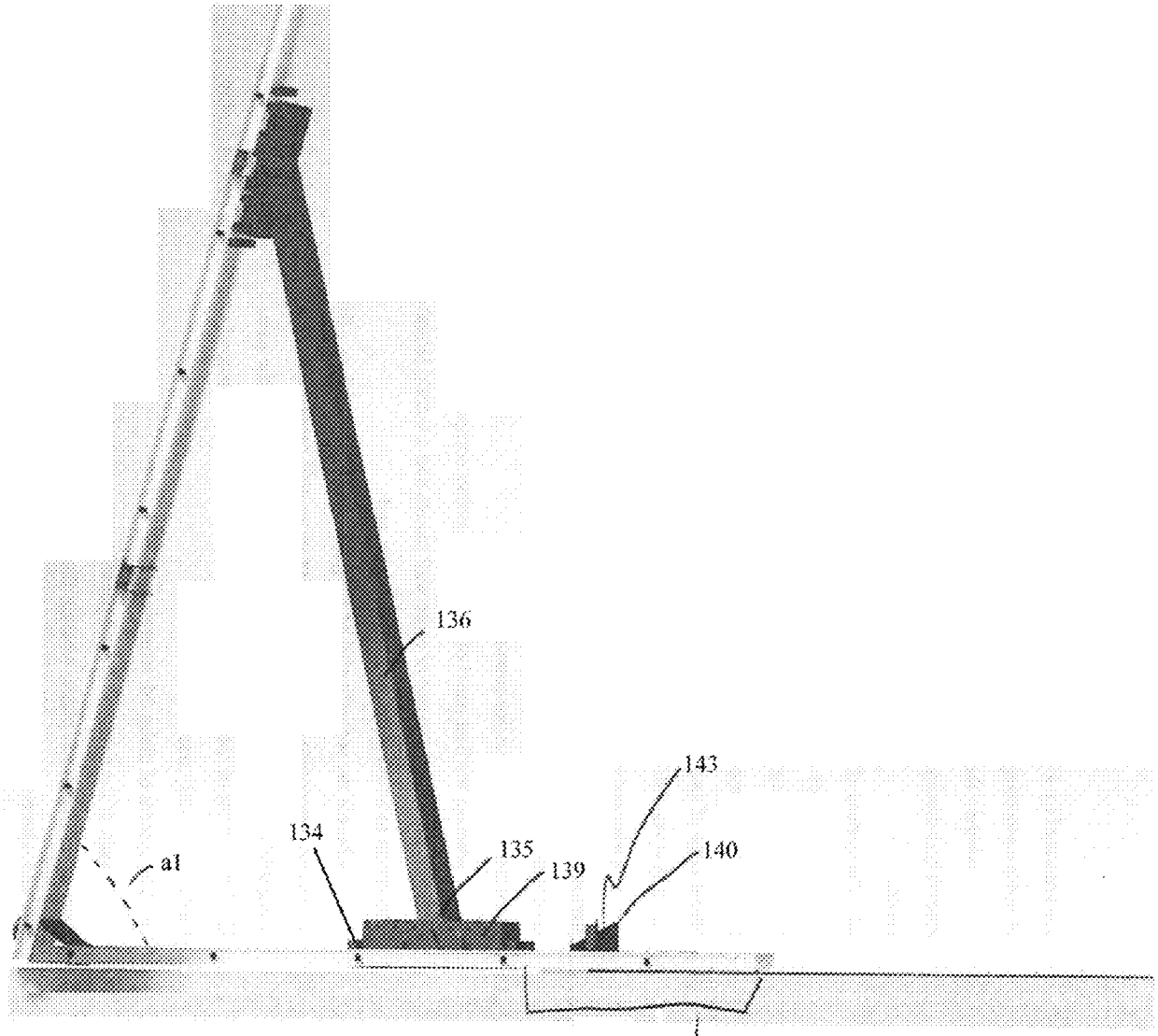
FIG. 14 is a side view of an alternative embodiment of the nonconductive, modular barrier assembly constructed in accordance with the present invention that includes a securement structure that renders the barrier assembly reversibly connectable to a counterbalance structure, such as a mat.
Figure 15:
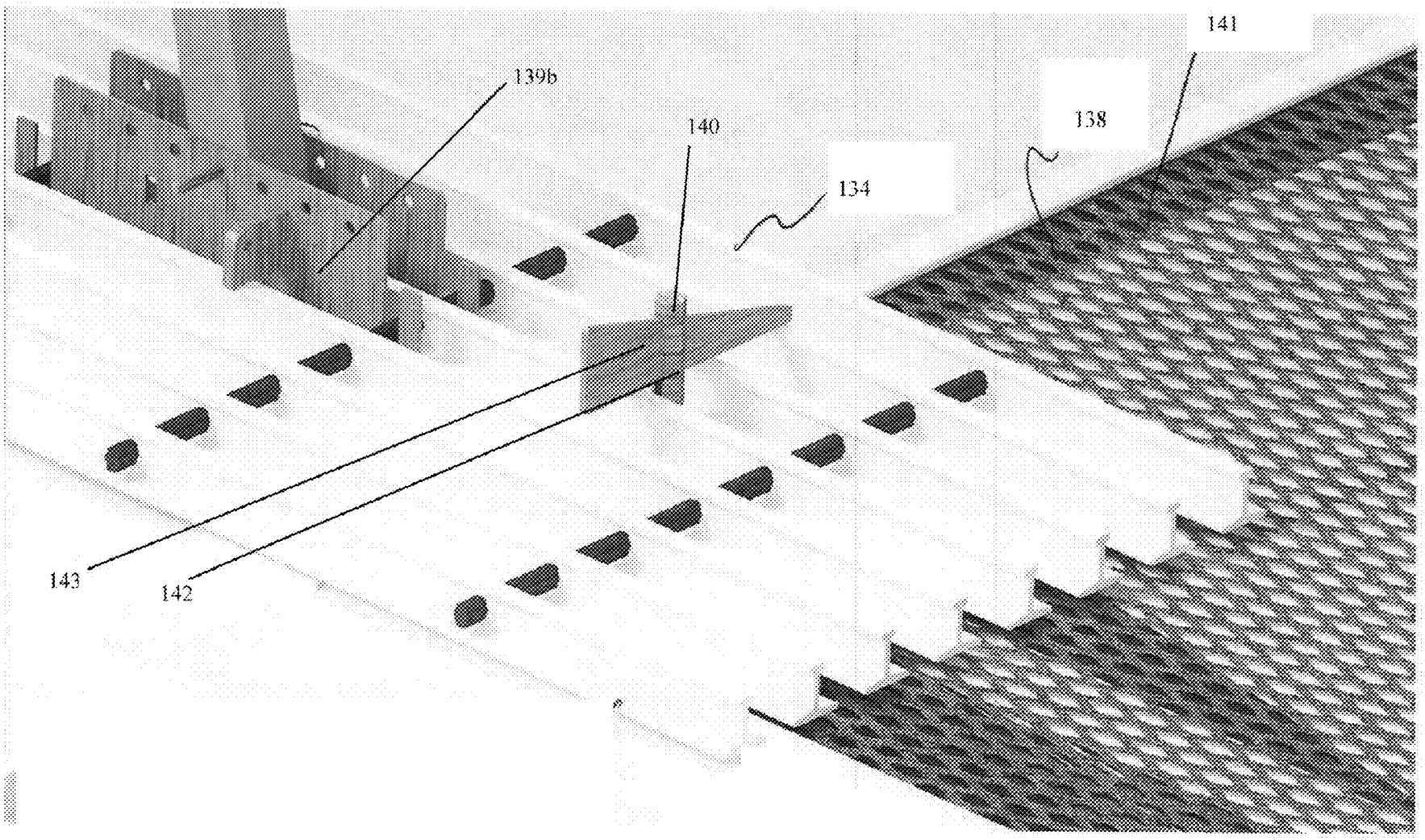
FIG. 15 is a detail view of the securement structure engaged with the mat.
Figure 16:
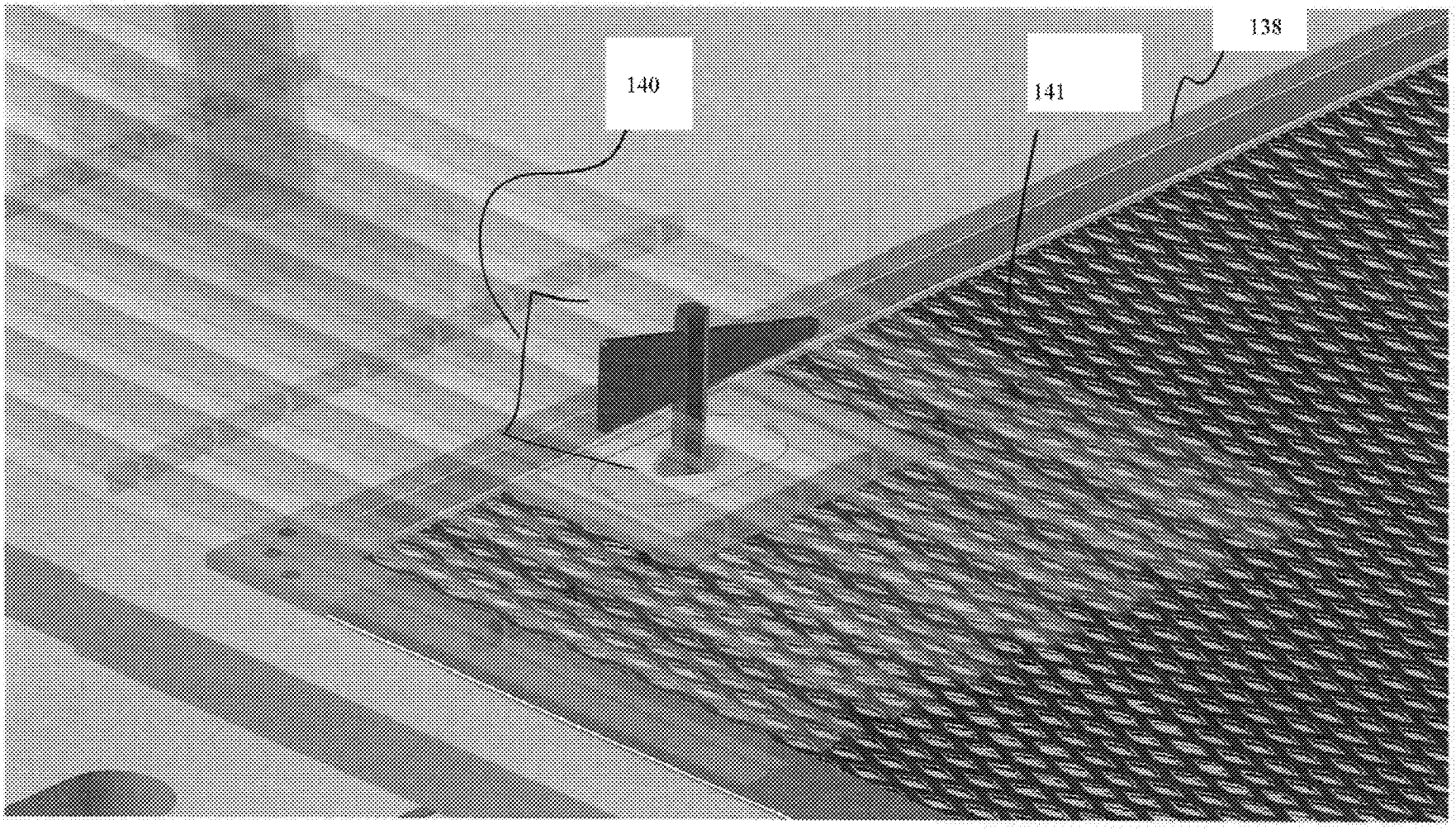
—and FIG. 16 is a view of FIG. 15 where the securement apron is shown as a ghost structure to permit better viewing of a positionable switch which facilitates simple engagement/disengagement of the barrier assembly and counterbalance structure.

Alternatively, with reference to FIGS. 14-16, additional stability of the support assembly is built into the base. In such embodiment, for example, the base 130 is dimensioned to extend beyond the bracket 139 that attaches the proximal end 135 of the support arm 136 to base 130 to provide or be on or adjacent to a securement apron 160. The securement apron 160 includes a mechanism that permits attachment of the base to counterbalance structure 127, such as a mat, pole, post, frame, wall, etc. at the site.

In the embodiment shown in the FIGS. 14-16, the counterbalance 127 is a perforated mat 138. The mat 138 bears a positionable switch 140 extending from the top surface 141 of the mat 138. The switch 140 includes a peg 142 and a flange 143; the peg 142 is dimensioned to be small enough to extend through a corresponding hole or aperture in the securement apron 160. The flange is of a geometry such that when it is in the "open position", the flange and the peg can be threaded through the hole/aperture of the securement apron 160 and when positioned to the "closed position" (see FIG. 16, for example) the flange cannot be pulled back through the hole or aperture, thereby reversibly securing the support assembly 130 to the counterbalance 127, which is in this example, the mat 138. However, any mechanism of attachment to the securement apron may be used, for example, a cable, a rod, a screw etc. In many embodiments, it is preferred that the attachment mechanism and/or the counterbalance structure are made of non-conductive materials. In an embodiment, the counterbalance structure may be an equipotential zone grounding mat.

Figure 7:
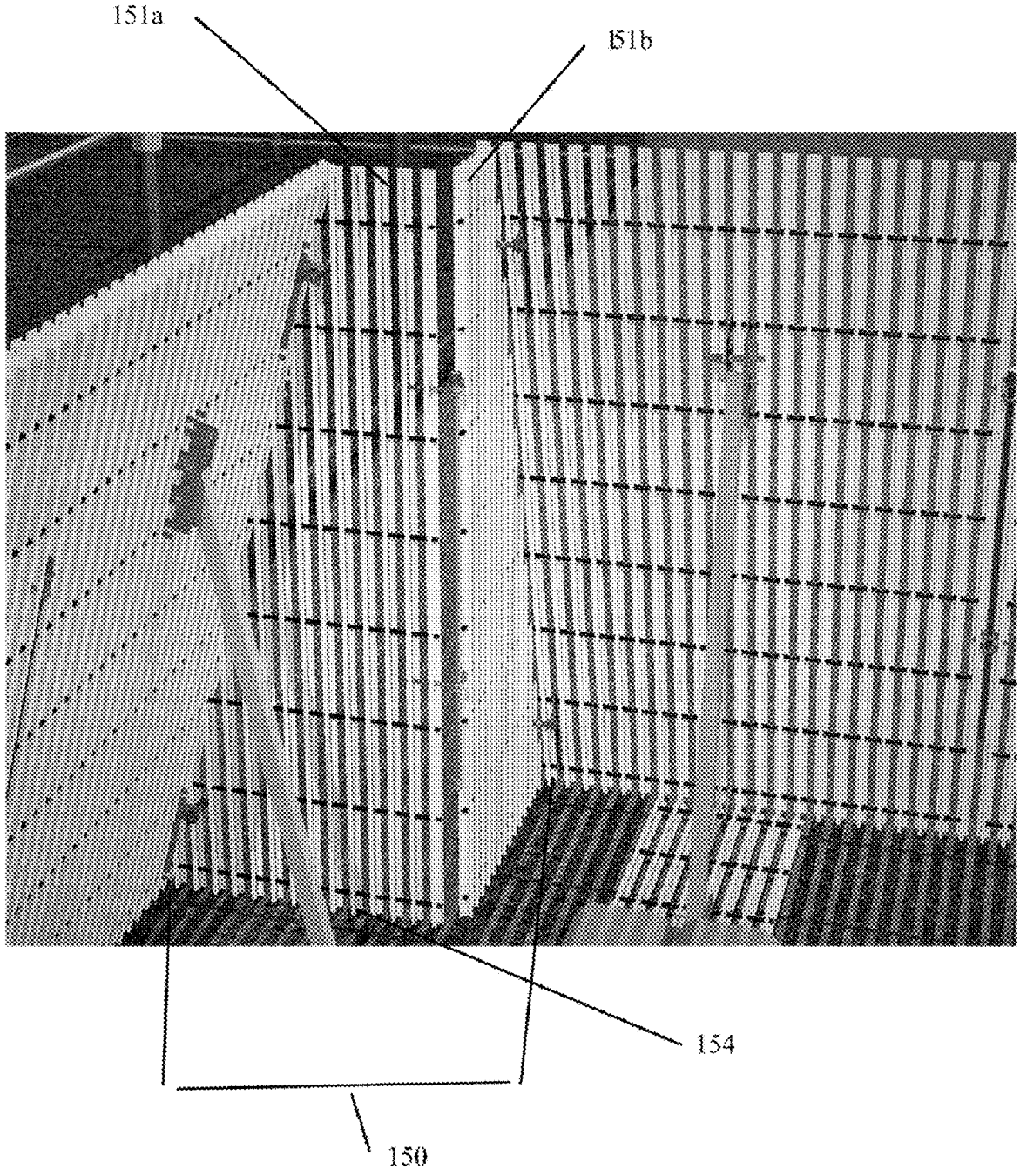
FIG. 7 is a perspective view of a corner assembly of the nonconductive, modular barrier assembly of the present invention as viewed from the interior of the enclosed area.

Referring now to FIG. 7, there is shown a perspective view of a corner assembly of the nonconductive, modular barrier assembly as viewed from the area enclosed by the modular barrier assembly. As the wall panels 110 are substantially linear in configuration, corner assemblies 150 are required to connect wall panels 110 arranged along different portions of the perimeter of the area to be enclosed. For example, the corner assembly 150 may be used to connect a first wall panel 110*a* to a second wall panel 110*b* that is arranged substantially perpendicularly to the first wall panel 110*a*. The corner assemblies 150 allow the nonconductive, modular barrier assembly subunit 100 to provide a continuous barrier along the entire perimeter of an area.

Each corner assembly 150 comprises a first corner panel 151*a* and a second corner panel 151*b*. The first corner panel 151*a* and the second corner panel 151*b* are substantially identical in shape and dimensions and for simplicity, the construction of one panel 151 of the corner assembly 150 will be discussed and is understood as applying to both the first and second panels 151*a*, 151*b*.

Figure 7A:
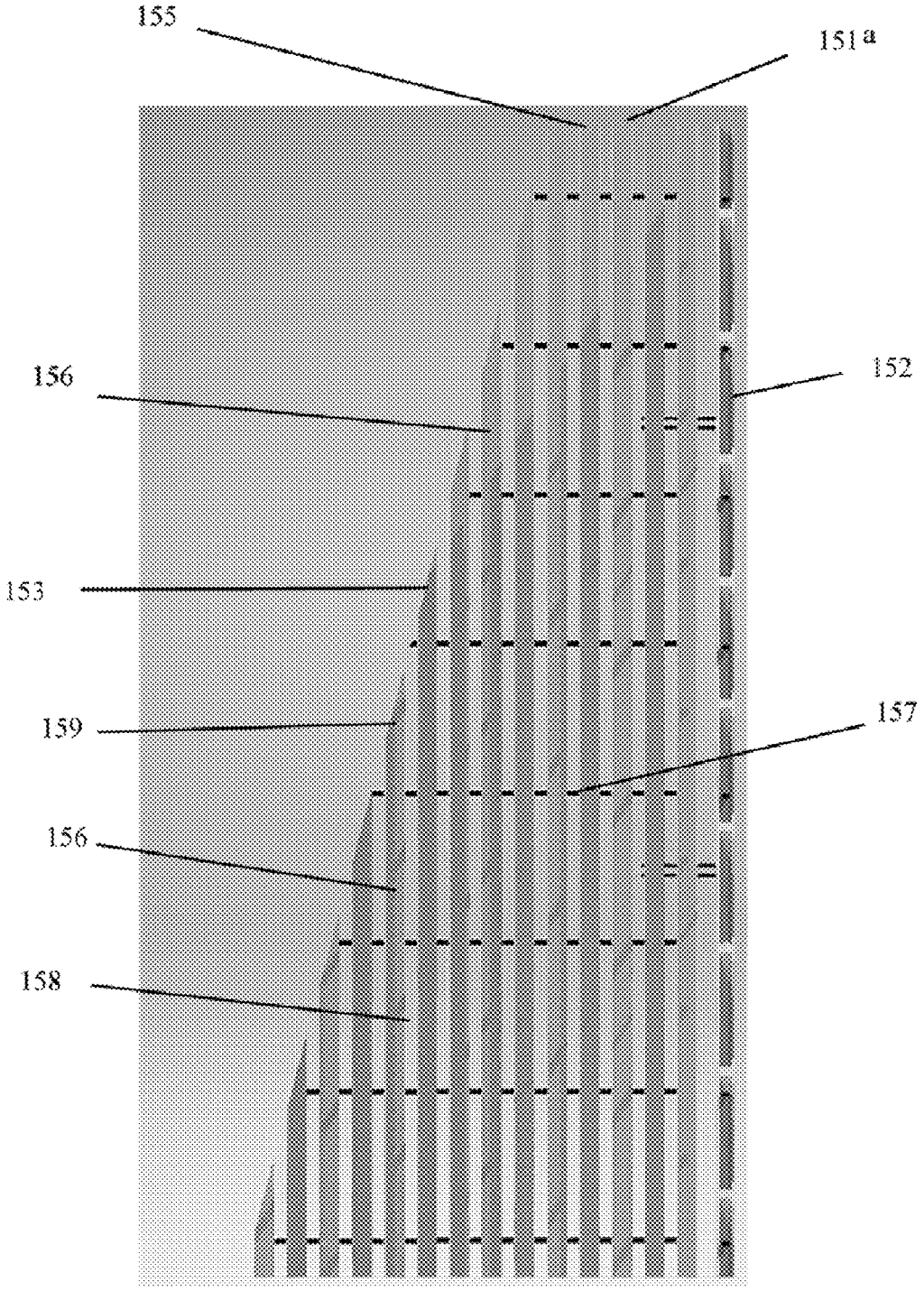
FIG. 7A is a front elevational view of a corner assembly panel ("CAP") of the corner assembly of FIG. 7.
Figure 7B:
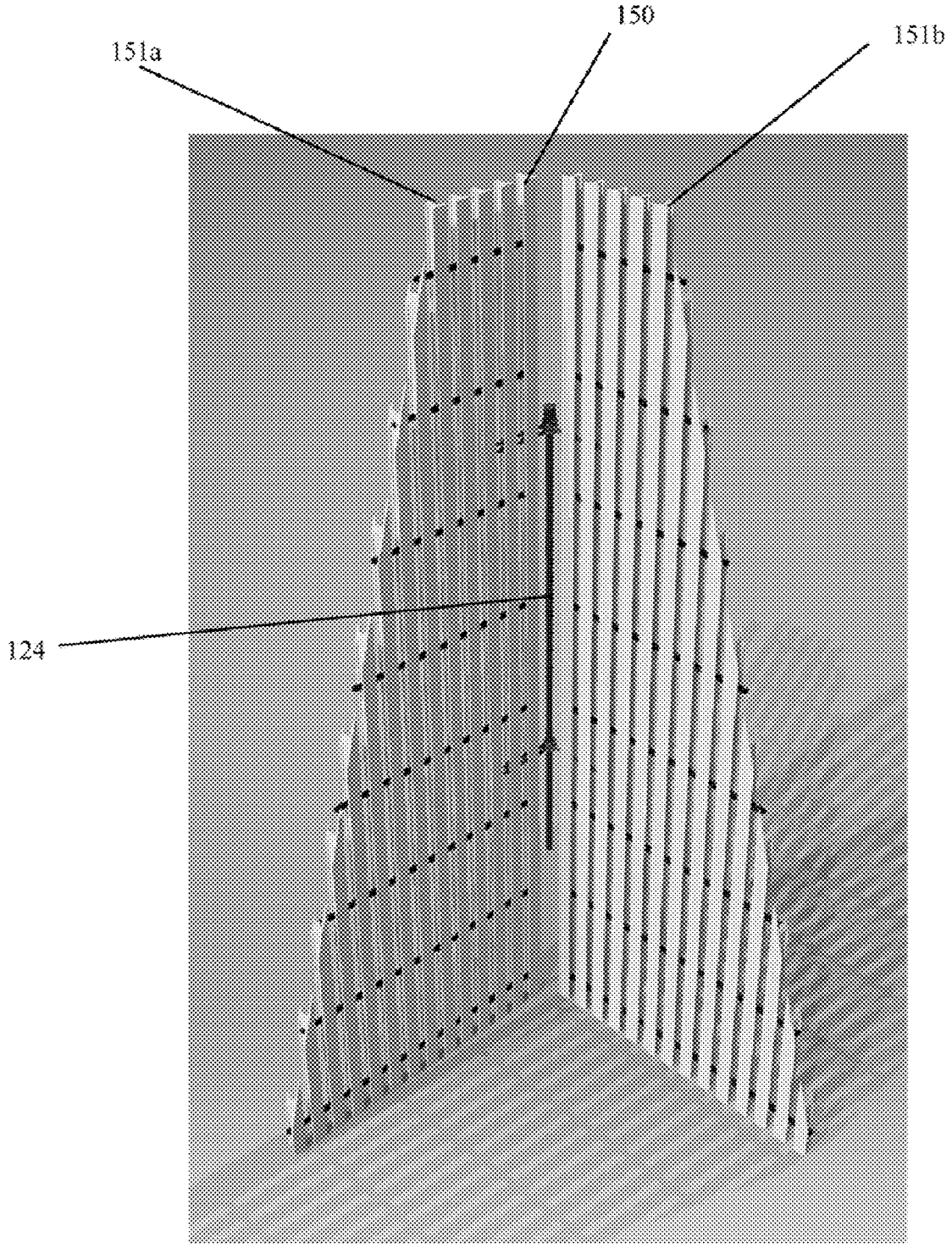
FIG. 7B shows the corner section of FIG. 7 where a first corner panel and a second corner panel each having corresponding flange bolted to their lateral edges. The panels are arranged at angle $a_3$ relative to one another and secured together at the edges by a rod that passes through the eyelets of the engaged flanges.
Figure 7C:
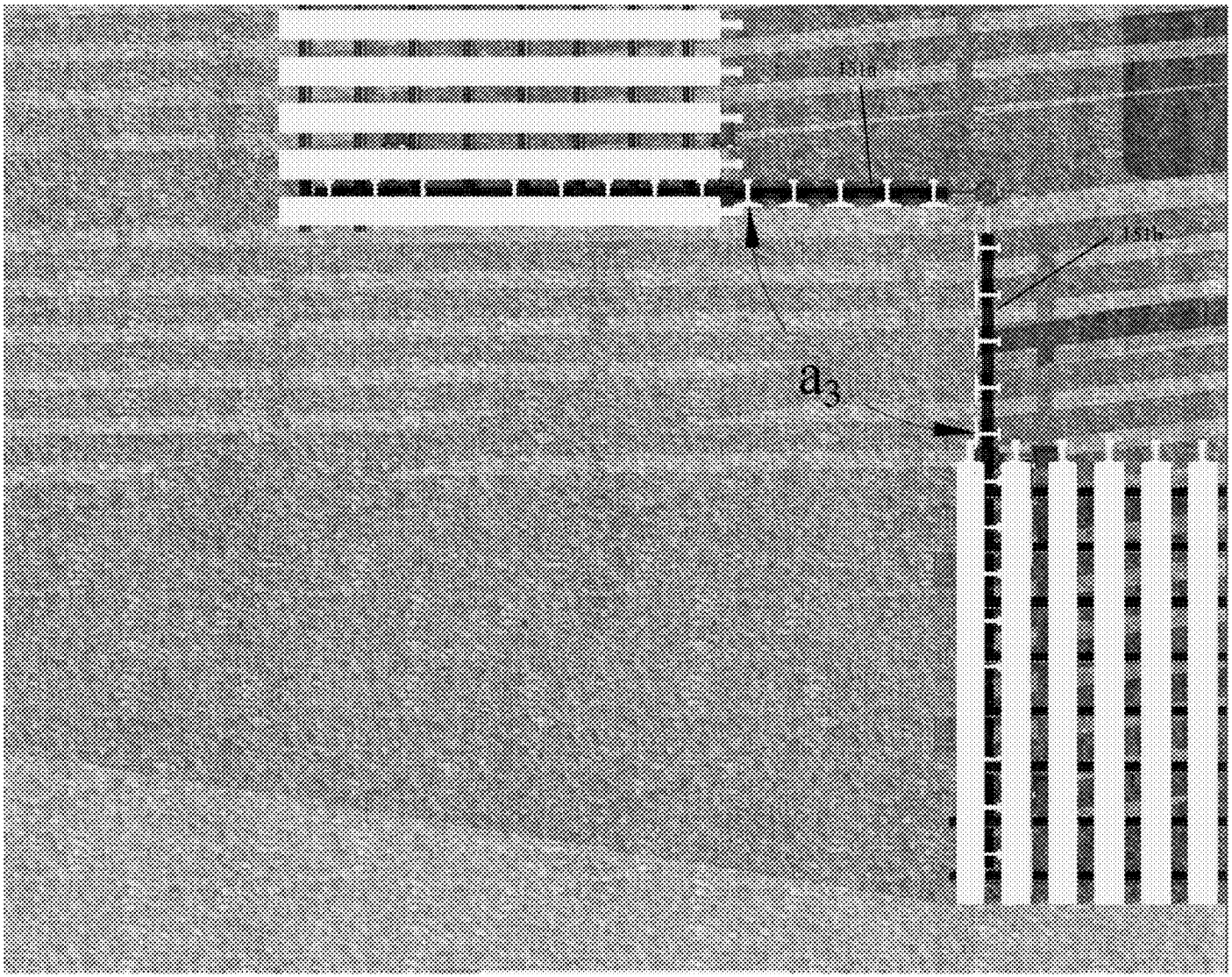
FIG. 7C shows the location of the angle $a_3$ as being between the exterior side of the first corner panel and the exterior side of the second corner panel.
Figure 10:
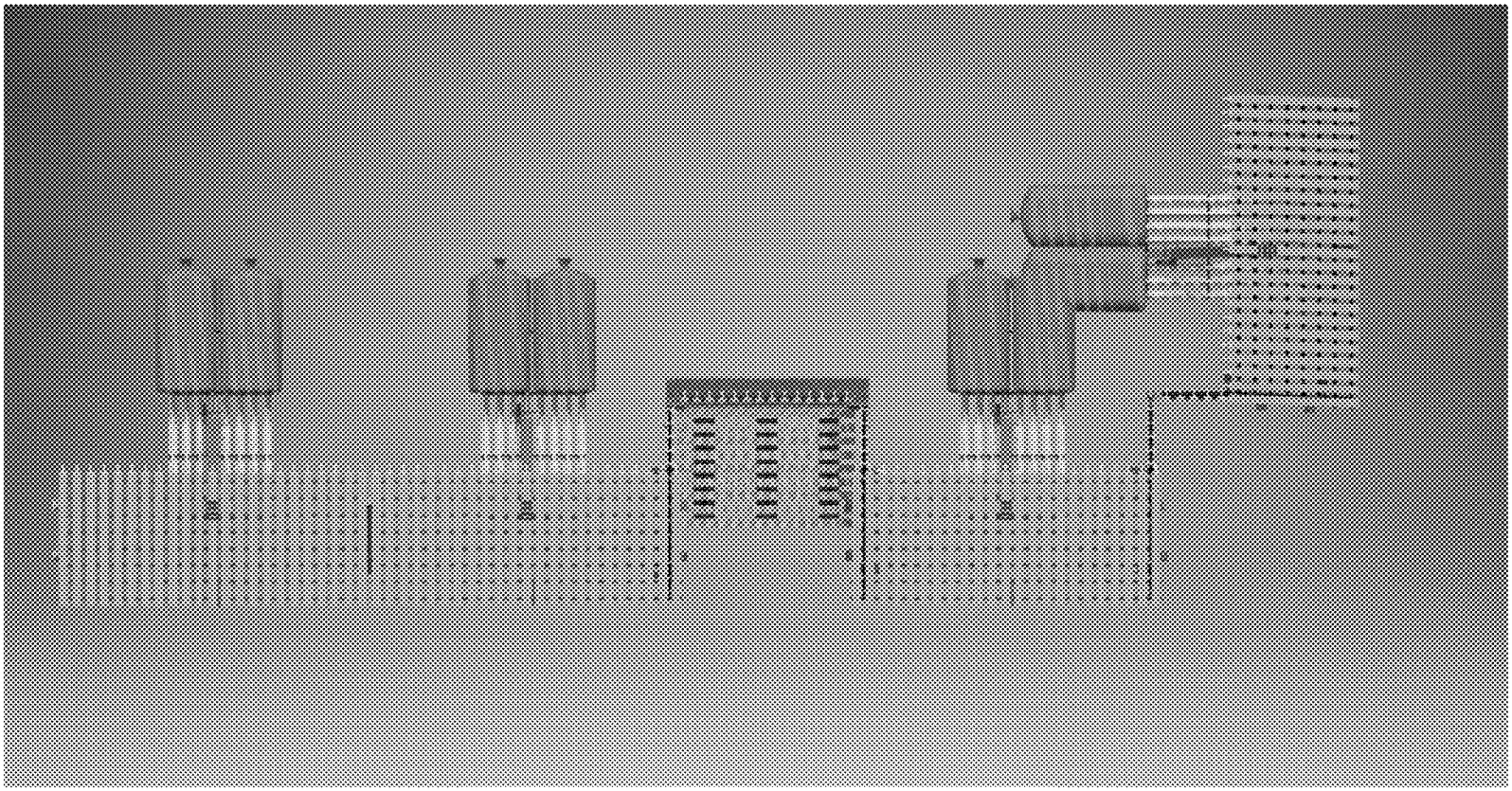
FIG. 10 shows a top elevational view of a nonconductive, modular barrier assembly constructed in accordance with the present invention.

As shown in FIG. 7A, each panel 151 includes a first lateral edge 152 and a second lateral edge 153. The first lateral edge 152 of each panel 151 is configured to be releasably connected to a lateral edge of a wall panel 110. Preferably, the wall panels 110 are arranged substantially perpendicularly to a panel 151 of the corner assembly 150 when connected thereto, as shown in FIG. 10. The second lateral edge 153 of each panel 151 is releasably connected to the second lateral edge 153 of the other panel 151 so that the first panel 151 is arranged non-linearly with respect to the second panel 151. Thus, an angle, $\alpha_3$, is formed between the first panel 151 and second panel as shown by FIG. 10. The angle $\alpha_3$ is preferably about 5 to about 175 degrees.

Where the wall panels 110 to be connected by the corner assembly 150 are arranged substantially perpendicularly to one another, the angle $\alpha_3$ between the first and second panels 151 is about 90 degrees. However, the angle $\alpha_3$ between the first and second panels 151 can be selected and adjusted as necessary to connect the wall panels 110 (See FIG. 7C), for example, about 75 degrees to about 100 degrees.

The first and second panels 151 of the corner assembly 150 are constructed in the same manner as the wall panels 110 of the nonconductive, modular barrier assembly subunit 100. Thus, the first and second panels 151 each include a plurality of nonconductive posts 156 that are arranged in a common plane and adjacent posts 156 are separated by a gap 158, i.e., spaced apart. Preferably, the posts 156 in each panel 151 of the corner assembly 150 are substantially parallel to one another. The plurality of posts 156 are connected by connecting rods 157, and the connecting rods 157 are preferably arranged generally transversely to the plurality of posts 156. The posts 156 and connecting rods 157 may have the same shape, configuration, features and materials of construction as discussed above with respect to the wall panels 110.

In a preferred embodiment, each corner panel 151 of the corner assembly 150 has a generally trapezoidal shape as shown in FIG. 7A, and the first lateral edge 152 of each panel is angled relative to the second lateral edge 153 thereof. Thus, the width of the first and second corner panels 151 tapers from the lower end 154 towards an upper end 155 of each corner panel 151. In order to form the angled first lateral edge 152, the posts 156 used to construct the first and second panels 151 increase in length from the first lateral edge 152 towards the second lateral edge 153 of each panel 151. Further, the upper end 159 of each post 156 that forms part of the first lateral edge 152 may be beveled. The first lateral edge 152 of the corner panel 151 is angled so as to support the wall panel 110 at the desired angle relative to the support surface. In this way, the corner assembly 150 also helps to support the wall panels 110 in the desired, tilted orientation.

When installing the corner assembly 150 of the nonconductive, modular barrier assembly subunit 100, the first and second panels 151 are arranged substantially perpendicularly with respect to the support surface 500 as shown in FIG. 7 and are positioned with the desired angle formed between the first and second panels 151. As the first and second corner panels 151 of the corner assembly 150 are arranged substantially perpendicularly to the support surface 500, support assemblies are not required to support the corner assembly 150. A lateral edge of a wall panel 110 that is positioned at an angle relative to the support surface is connected to and along the first lateral edge 152 of each panel 151 of the corner assembly 150 so that the corner assembly 150 supports the wall panels 110 and helps to maintain the wall panels 110 in the desired orientation. The lateral edge of the wall panel 110 may be connected to the first lateral edge 152 of each panel 151 using any of the fastening methods as described above for connecting two wall panels 110, such as a clamp or by inserting a rod through aligned eyelets on flanges arranged on the lateral edges of a first or second panel 151 of the corner assembly 150 and on the lateral edge of a wall panel 110.

Figure 8:
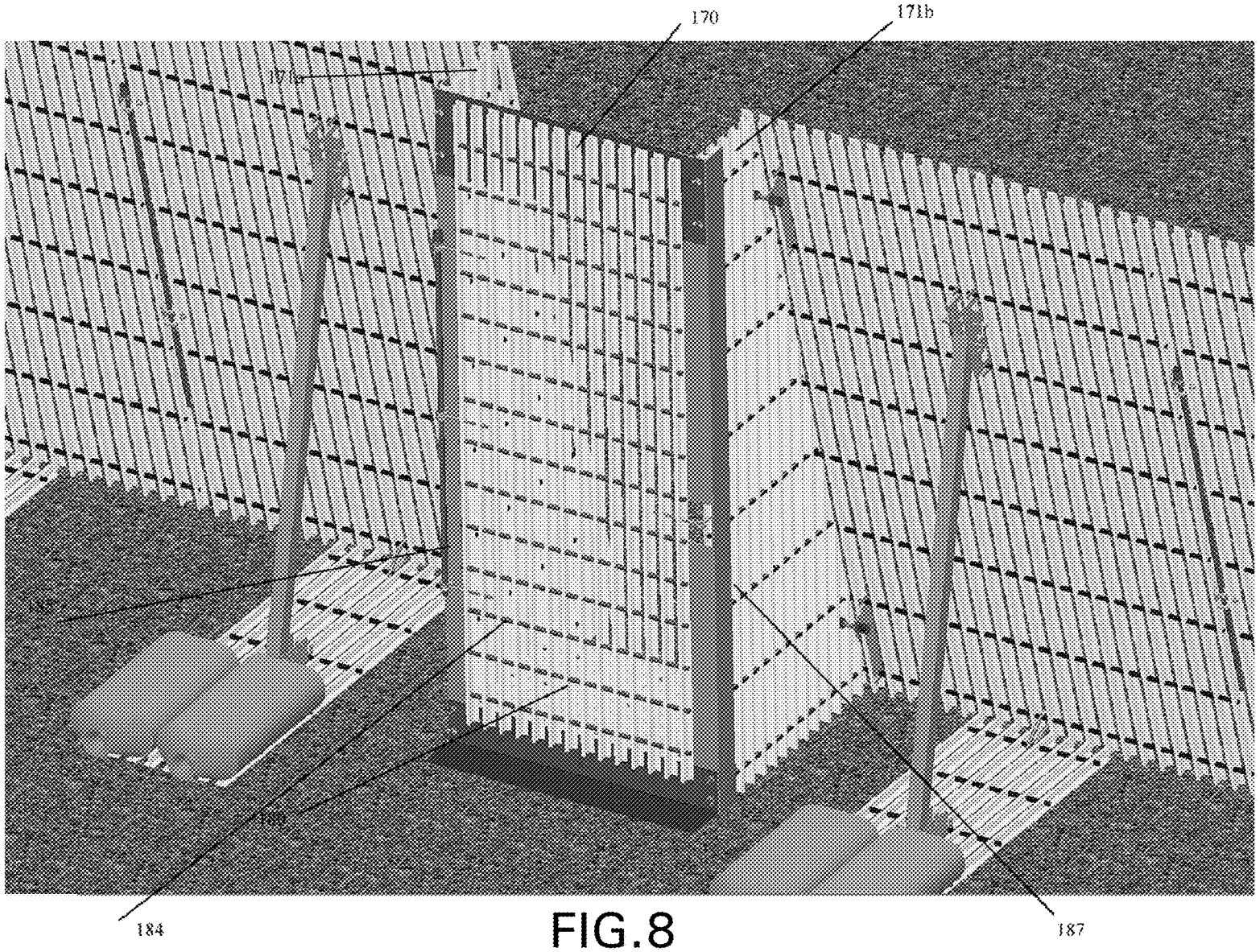
FIG. 8 shows a perspective view of a gate assembly of the nonconductive, modular barrier assembly of the present invention as viewed from the interior of the enclosed area.
Figure 8A:
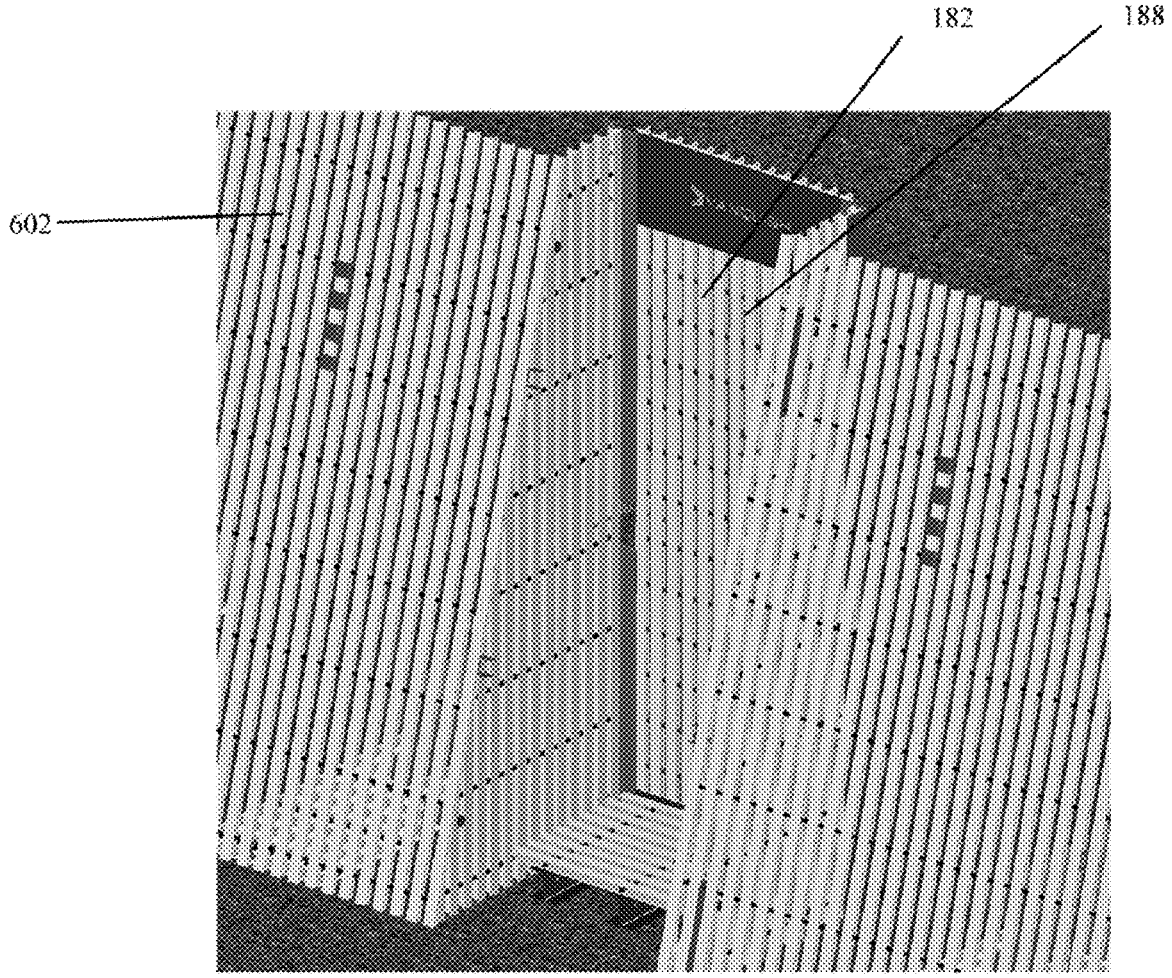
FIG. 8A shows the gate assembly of FIG. 8 from the opposite side, i.e., from the exterior of the enclosed area.

Referring now to FIG. 8 and FIG. 8A, there is shown a perspective view of a gate assembly of the nonconductive, modular barrier assembly of the present invention in a closed configuration as viewed from the area enclosed by the nonconductive, modular barrier assembly and a similar view observed from the exterior of the enclosed area.

In this embodiment, the gate assembly 170 includes a first panel 171*a*, a second panel 171*b* and a gate 180. The first panel 171*a* and second panel 171*b* have substantially the same shape and configuration. Each panel 171 includes a first lateral edge 172 and a second lateral edge 173. When installed, the first and second panels 171 of the gate assembly 170 are arranged substantially perpendicularly to the wall panels 110 and parallel to one another, as shown in FIGS. 8 and 10. Further, the first and second panels 171 are arranged substantially perpendicularly with respect to the support surface. The first lateral edge 172 of each panel 171*a*, 171*b* is releasably connectable to a lateral edge of a wall panel 110. The releasable connection may be accomplished by any of the fastening methods described above for connecting two wall panels 110, such as by the use of clamps or by inserting a rod through flanges on the lateral edges of the panels having eyelets for receiving the rod. The second lateral edge 173 of each of the first and second panels 171 is designed for releasable connection to a lateral edge of the gate 180 of the gate assembly 170. The gate 180 is configured to be positioned substantially perpendicularly to the first and second panels 171 of the gate assembly 170, and substantially perpendicularly with respect to the support surface. No support assemblies are required to support the gate assembly 170 as the components of the gate assembly 170 are arranged substantially perpendicularly with respect to the support surface.

A first lateral edge 185 of the gate 180 is releasably connectable to a second lateral edge 173 of the first panel 171*a* of the gate assembly 170. A second lateral edge 187 of the gate 180 is releasably connected to a second lateral edge 173 of the second panel 171*b* of the gate assembly 170. Preferably, the releasable connection of the second lateral edge 187 of the gate 180 with the second lateral edge 173 of the second panel 171*b* is accomplished using a hinge so that the gate 180 can pivot about the hinge between open and closed configurations. The gate 180 may further include a latch assembly having a latch and a latch receiver (not shown). The first lateral edge 187 of the gate 180 may include a latch that is configured to mate with a latch receiver positioned on the second lateral edge 173 of the first panel 171*a* of the gate assembly 170. The latch assembly allows the gate 180 to be selectively locked to maintain the gate 180 in a closed configuration.

The first and second panels 171 of the gate assembly 170 are constructed in the same manner as the wall panels 110. Thus, the first and second panels 171 each include a plurality of nonconductive posts 156 that are arranged in a common plane and each post 156 is separated by a gap, i.e., spaced apart 158. The posts 156 are preferably substantially parallel to one another. The plurality of nonconductive posts 156 are connected by one or more connecting rods 157. The connecting rods 157 are preferably arranged transversely to the plurality of nonconductive posts 156. The nonconductive posts 156 and the connecting rods 157 may have the same shape, configuration, features and materials of construction as discussed above with respect to the wall panels 110.

Further, the first and second panels 171*a*, 171*b* of the gate assembly 170 may be configured in a similar manner as the first and second panels 151*a*, 151*b* of the corner assembly 150 and preferably each have a generally trapezoidal configuration. The first lateral edges 172 of each panel 171 of the gate assembly 170 may be arranged at an angle relative to the second lateral edge 173 of each panel 171, in a similar manner as described above with respect to the first and second panels 151 of the corner assembly 150. The angle of the first lateral edge 172 of the first and second panels 171 is selected so as to support a wall panel 110 at the desired angle relative to the support surface when the wall panel 110 is releasably connected to the first lateral edge 172 of the first or second panel 171 of the gate assembly 170.

The gate 180 may be formed in the same manner as described above with respect to the wall panels 110. Thus, the gate 180 includes a plurality of nonconductive posts 182 arranged in a common plane, and each nonconductive post 182 is separated from the adjacent nonconductive posts 182 by a gap 188. Preferably, the nonconductive posts 182 are substantially parallel to one another. The nonconductive posts 182 of the gate 180 are connected by one or more connecting rods 184. The connecting rods 184 extend generally transversely to the plurality of nonconductive posts 182. The nonconductive posts 182 and connecting rods 184 may have the same shape, configuration, features and materials of construction as discussed above with respect to the wall panels 110.

Figure 9:
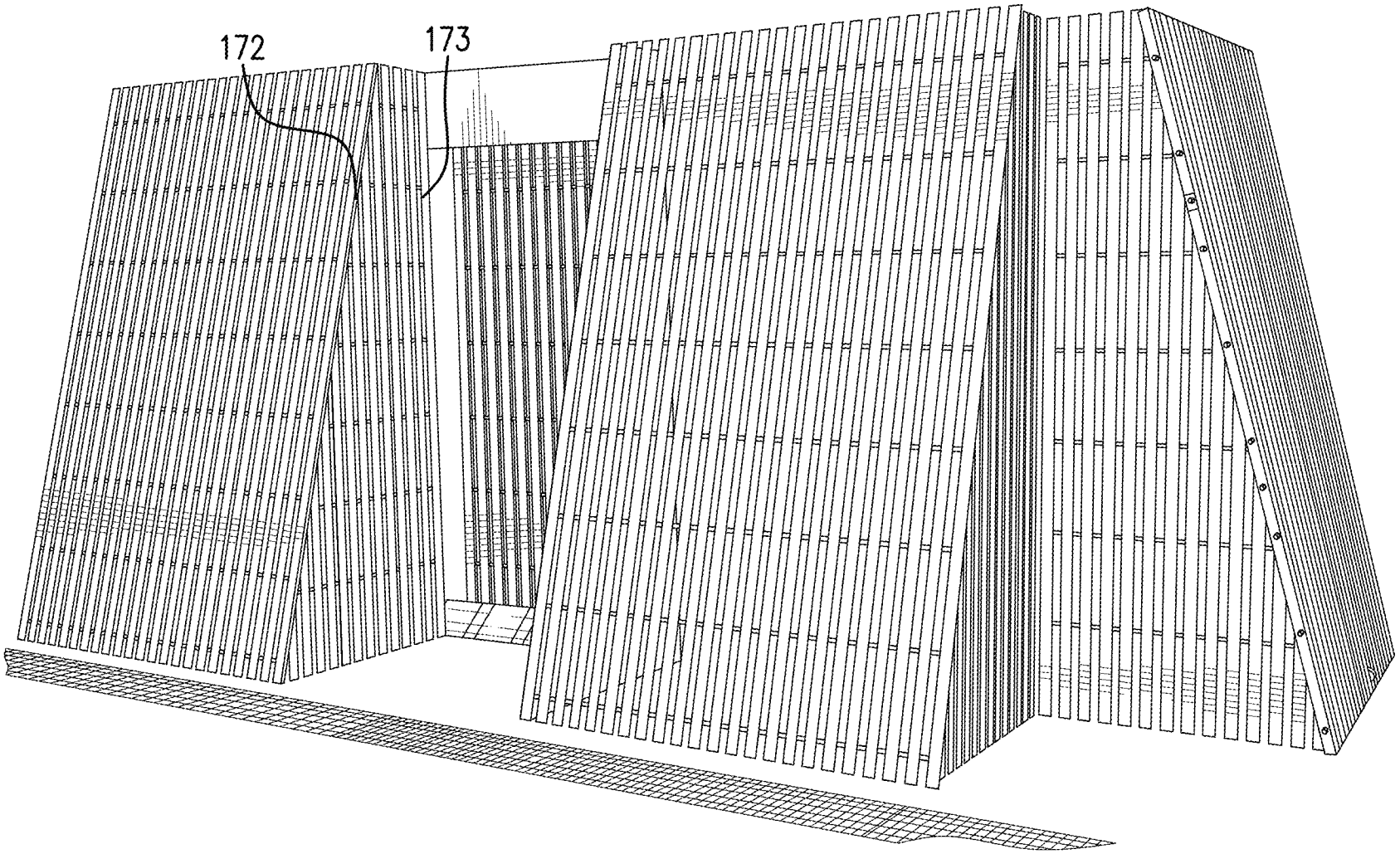
FIG. 9 shows a perspective view of a portion of an embodiment of a nonconductive, modular barrier assembly constructed in accordance with the present invention.
Figure 9A:
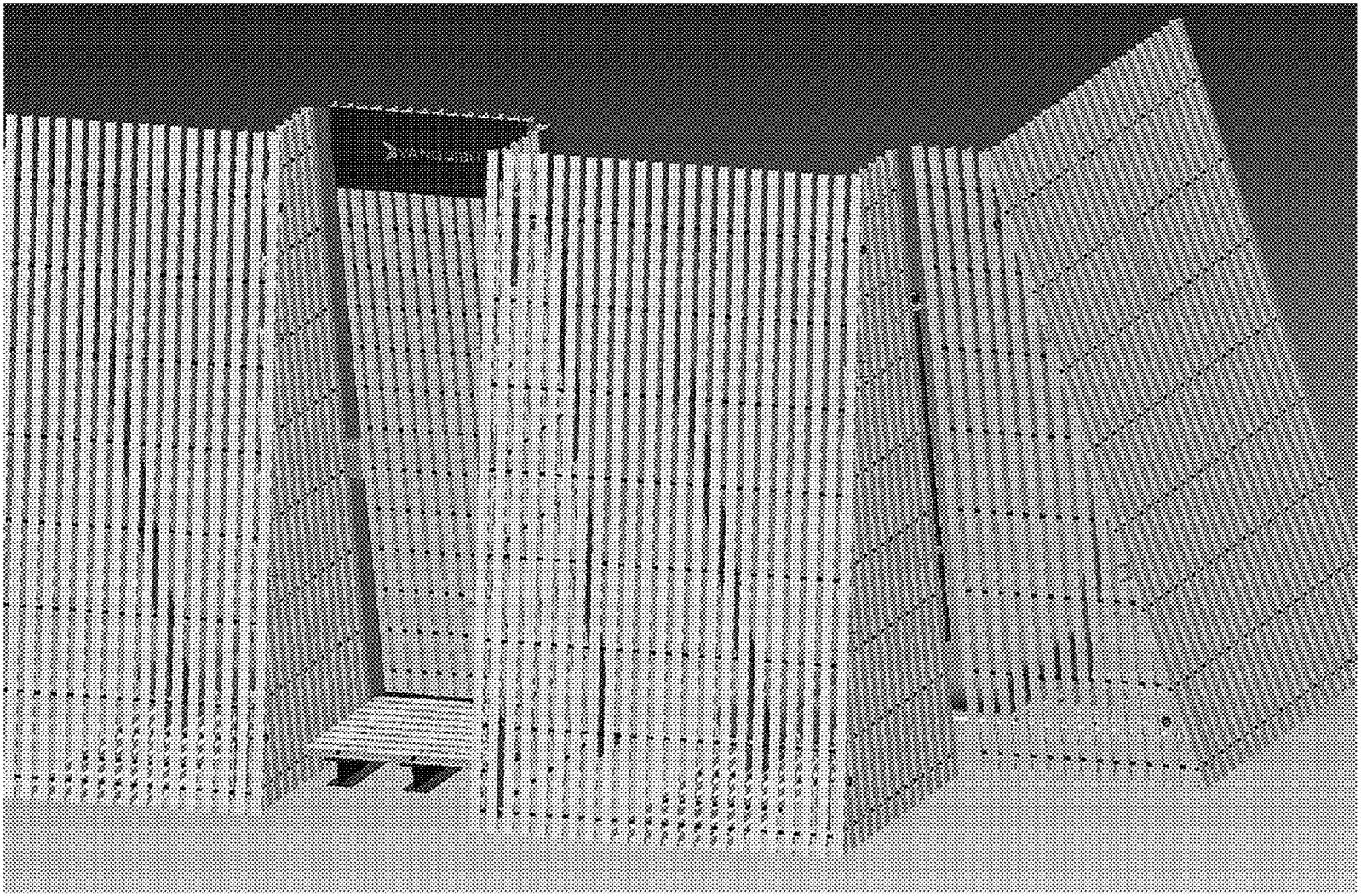
FIG. 9A shows a perspective view of a portion of an embodiment of a nonconductive, modular barrier assembly constructed in accordance with the present invention.

Referring now to FIG. 9, there is shown a perspective view of a modular barrier assembly constructed according to the present invention. In the illustrated embodiment, a gate assembly 170 is provided with a wall panel 110 on either side of the gate assembly 170. Each wall panel 110 is tilted at an angle with respect to the support surface and towards the enclosed area. Further, each wall panel 110 is supported by a support assembly. A corner assembly 150 is connected to a wall panel 110 adjacent the gate assembly 170 and is connected to an additional wall panel 110 on the opposing side of the corner assembly 150.

A customized barrier can be assembled using the nonconductive, modular barrier assembly subunit(s) 100 of the present invention by selecting the number and configuration of wall panels 110 as well as the number of and position of corner assemblies 150 and gate assemblies 170 and releasably connecting the selected components to one another. Support assemblies are provided to support the wall panels 110 in the desired orientation so as to provide strength and stability to the nonconductive modular barrier assembly subunit 100 without the need for a foundation or other connection to the support surface.

Figure 12:
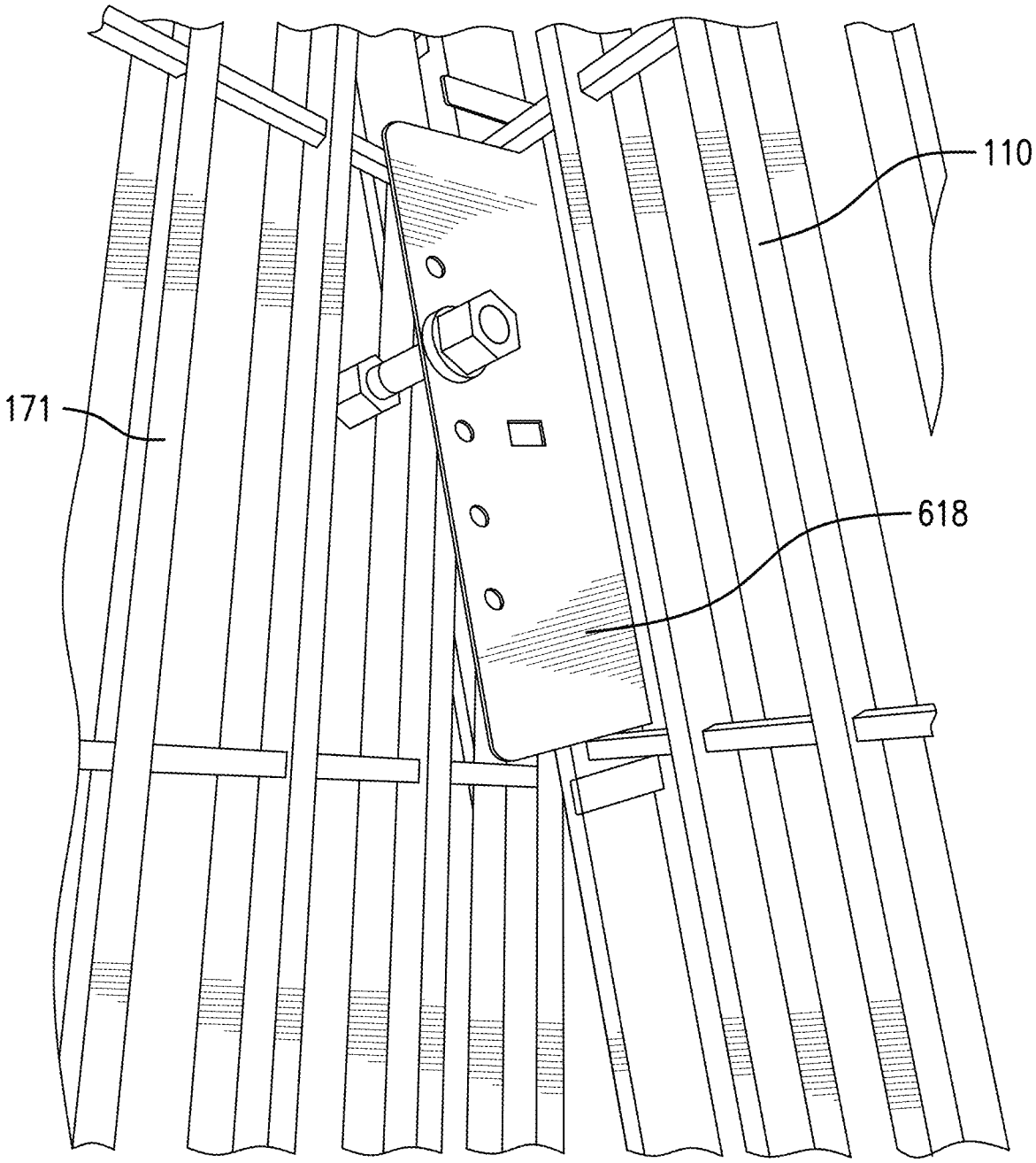
FIG. 12 shows an up-close side view of a t connection bracket that, in various embodiments, can be used to make connections at corners.

FIG. 12 shows an up-close side view of a second, alternative, connection bracket 618 that, in various embodiments, can be used to make connections at corners. In the embodiment shown in FIG. 12, the connection bracket is the same as that used to connect the support assemblies, i.e., the same structure and analogous mechanism of connection of bracket 139. See, e.g., FIGS. 5B and 5C. It is shown connecting a wall panel 110 to a gate panel 171.

Figure 13:
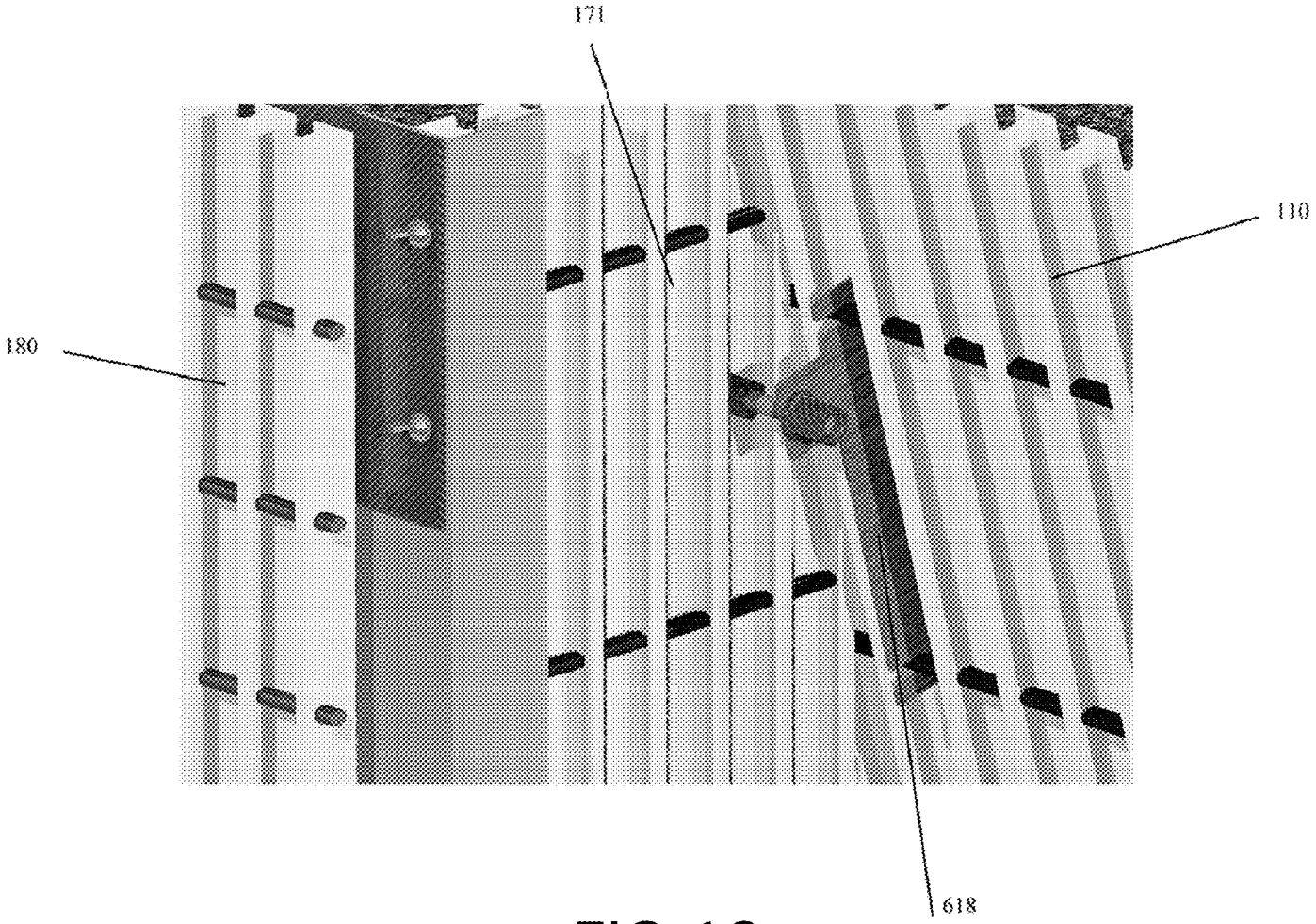
FIG. 13 shows a view of a connection bracket that is being used to connect a wall panel to a gate panel of a gate assembly, which in turn is connected to a gate.

FIG. 13 shows a view of a connection bracket 618 that is being used to connect a wall panel 110 to a gate panel 171, which in turn is connected to a gate 180, all of a gate assembly 170. In the embodiment shown in FIG. 13, the connection bracket is the same as that used to connect the support assemblies, i.e., the same structure and analogous mechanism of connection of bracket 139. See, e.g., FIGS. 5B and 5C.

The present invention also relates to methods of installing a nonconductive, modular barrier assembly including arranging one or more wall panels in a substantially upright orientation on a support surface and supporting the wall panels using one or more support assemblies as described herein. The wall panels may be arranged at an angle relative to the support surface on which they are positioned and are preferably angled or tilted towards the enclosed area. In order to support the wall panels in the desired orientation, the support assembly can be positioned in the area to be enclosed by the nonconductive, modular barrier assembly. The base is positioned directly on the support surface, a proximal end of the support arm is releasably connected to the base, and the distal end of the support arm is releasably connected to a wall panel, such as to a post of the wall panel. The releasable connection may be accomplished by brackets, such as quick-release brackets as described above.

A number of wall panels may be installed on a support surface to provide a barrier of a desired length by releasably connecting the wall panels in a side-by-side manner. The method of installing a modular barrier assembly may further include providing one or more corner assemblies of the type described herein and releasably connecting one or more corner assemblies to the wall panels. Each corner assembly includes a first panel and a second panel, and each panel is positioned substantially perpendicularly with respect to the support surface. Further, the first panel and second panel of the corner assembly are arranged non-linearly. The corner assembly can be releasably connected to the wall panels by any of various fastening methods as described herein, such as by the use of clamps. Alternatively, the lateral edge of each wall panel and the first lateral edge of the first or second panel of the corner assembly may have flanges with eyelets. The eyelets of a wall panel and a panel of the corner assembly can be aligned so that a rod can be inserted through the aligned eyelets to connect the wall panel to the corner assembly.

The method of installing a modular barrier assembly may further include releasably connecting one or more gate assemblies of the type described herein to the wall panels of the modular barrier assembly. The gate assembly includes a first panel, a second panel and a gate. The first and second panels are positioned substantially parallel to one another and substantially perpendicularly with respect to the support surface. The gate is also positioned substantially perpendicularly with respect to the support surface and is substantially perpendicularly relative to the first and second panels of the gate assembly. The gate assembly can be installed by releasably connecting each of the first and second panels of the gate assembly to a wall panel by releasably connecting the lateral edge of a wall panel to a first lateral edge of a first or second panel of the gate assembly. Further, the gate can be releasably connected to the second lateral edges of the first and second panels of the gate assembly, and the gate is preferably connected to one of the first or second wall panels via a hinge so that the gate can be selectively moved between an open and closed configuration.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims

I claim:

1. A nonconductive, modular barrier assembly comprising at least two subunits and a gate assembly, wherein:

each subunit comprises:

a wall panel, wherein the wall panel comprises a plurality of nonconductive posts arranged substantially side-by-side and each separated from the other by a wind gap and the wall panel is releasably connected to a base to form an angle (a1) between a top surface of the base and an interior face of the wall panel;

one or more support assemblies, wherein each support assembly comprises a base and at least one support arm and a distal end of the at least one support arm is releasably connected to the wall panel and a proximal end of the at least one support arm is releasably connected to the base, and the base is positioned on a support surface, wherein the subunits are arranged so that a second edge of a wall panel of a first subunit is positioned substantially adjacent to a first edge of a wall panel of a second subunit; and the gate assembly comprises a first panel having a first lateral edge and a second lateral edge, a second panel having a first lateral edge and a second lateral edge, and a gate having a first lateral edge and a second lateral edge;

wherein the first panel and the second panel are positioned substantially parallel to one another and substantially perpendicularly with respect to the support surface, and a first lateral edge of the gate is releasably connected to a second lateral edge of the first panel, and the second lateral edge of the gate is releasably connected to a second lateral edge of the second panel, wherein the gate is positioned substantially perpendicularly with respect to the support surface; and wherein a wall panel of the one or more wall panels is connected to one of the first lateral edge of the first panel and the first lateral edge of the second panel.

2. The barrier assembly of claim 1 wherein the plurality of nonconductive posts of the subunit is connected to one another by at least one connecting rod.

3. The barrier assembly of claim 1 wherein, in the subunit, the angle (a1) is about 50 to about 85 degrees.

4. The barrier assembly of claim 1 wherein, in the subunit, the plurality of nonconductive posts arranged substantially side-by-side in substantially the same plane.

5. The assembly of claim 1 further comprising:

a corner assembly that comprises a first corner panel with a first lateral edge and a second lateral edge, and a second corner panel with a first lateral edge and a second lateral edge, wherein the second lateral edge of the first panel is releasably connected to the second lateral edge of the second panel such that the first corner panel is positioned non-linearly with respect to the second panel and an edge of a wall panel is connected to the first lateral edge of the first corner panel or the first lateral edge of the second corner panel.

6. The barrier assembly of claim 5, wherein the first panel and the second panel of the corner assembly independently comprises a plurality of nonconductive posts arranged in a substantially common plane and separated by a gap.

7. The barrier assembly of claim 5, wherein an angle (a3) formed between an exterior face of the first corner panel and an exterior face of the second corner panel is about 75 degrees to about 100 degrees.

8. The barrier assembly of claim 1, wherein each of the first panel and the second panel of the gate assembly comprises a plurality of nonconductive posts arranged in a common plane and separated by a gap, wherein the plurality of nonconductive posts are connected by one or more connecting rods.

* * * * *